US008485085B2

(12) United States Patent
Goree et al.

(10) Patent No.: US 8,485,085 B2
(45) **Date of Patent: *Jul. 16, 2013**

(54) NETWORK WEAPON SYSTEM AND METHOD

(75) Inventors: John Goree, San Francisco, CA (US); Brian Feldman, San Francisco, CA (US)

(73) Assignee: Telerobotics Corporation, Goleta, CA (US)

( * ) Notice: Subject to any disclaimer, the term of this patent is extended or adjusted under 35 U.S.C. 154(b) by 1575 days.

This patent is subject to a terminal disclaimer.

(21) Appl. No.: 11/838,873

(22) Filed: Aug. 14, 2007

(65) Prior Publication Data

US 2012/0214137 A1 Aug. 23, 2012

Related U.S. Application Data

(63) Continuation-in-part of application No. 10/907,825, filed on Apr. 17, 2005, now Pat. No. 7,335,026, which is a continuation-in-part of application No. 10/907,143, filed on Mar. 22, 2005, now abandoned, which is a continuation-in-part of application No. 10/963,956, filed on Oct. 12, 2004, now Pat. No. 7,159,500.

(51) Int. Cl.
*F41G 3/00* (2006.01)
*F41G 3/26* (2006.01)

(52) U.S. Cl.
USPC ..... 89/41.17; 235/404; 434/16

(58) Field of Classification Search
USPC ..... 89/41.17; 235/404; 434/16, 21, 22
See application file for complete search history.

(56) References Cited

U.S. PATENT DOCUMENTS

| | | | | |
|---|---|---|---|---|
| 6,499,382 | B1 * | 12/2002 | Lougheed et al. | 89/41.05 |
| 6,955,296 | B2 * | 10/2005 | Lusher et al. | 235/400 |
| 7,121,464 | B2 * | 10/2006 | White | 235/400 |
| 7,159,500 | B2 * | 1/2007 | John et al. | 89/1.11 |
| 7,275,691 | B1 * | 10/2007 | Wright et al. | 235/404 |
| 7,335,026 | B2 * | 2/2008 | Goree et al. | 434/22 |
| 7,509,904 | B2 * | 3/2009 | Plumier | 89/41.05 |
| 2002/0012898 | A1 * | 1/2002 | Shechter et al. | 434/21 |
| 2002/0192622 | A1 * | 12/2002 | Perry et al. | 434/16 |
| 2002/0197584 | A1 * | 12/2002 | Kendir et al. | 434/21 |
| 2003/0228557 | A1 * | 12/2003 | Abe | 434/21 |
| 2007/0077539 | A1 * | 4/2007 | Tzidon et al. | 434/21 |
| 2008/0108021 | A1 * | 5/2008 | Slayton et al. | 434/16 |

* cited by examiner

*Primary Examiner* — Bret Hayes
(74) *Attorney, Agent, or Firm* — ARC IP Law, PC; Joseph J. Mayo

(57) ABSTRACT

Allows for the assignment of threat(s) to weapon(s) to allow operators to coordinate actions. Enables dynamic discovery and operation weapon(s), sensor(s) over a local or public network so available weapons can be selected by operators. Sensors may act as simulated weapons and may also reside in a video surveillance system (VSS). Sensors may be collocated or away from weapons which may differ in number. Sensors simulating weapons are transparently interchangeable with actual weapons. Simulated actors and events may be injected into system with operator gestures recorded for later analysis. Operator may control more than one weapon or sensor at a time. Operator user interface may be cloned onto another computer for real-time supervision or for later use. Integration of existing VSS with a network of remotely operated weapons or simulated weapons enables a passive video surveillance system upgrade to become a projector of lethal or non-lethal force.

6 Claims, 18 Drawing Sheets

Fig. 9

Content-Type: multipart/mixed;
boundary="_=_next_part_-560821453_=_"
MIME-Version: 1.0
--_=_next_part_-506284153_=_
Content-Type: text/plain 1500 This is a sensor data output message ecoded image --_=_next_part_-506284153_=_
Content-Type: image/jpeg
Content-Transfer-Encoding: base64

1501
VhGpcyBGpcyBGhIHBGhcnQGgaW4GgYSAGobX
VGsdGlGwYXJG0KSBGtZXNGzYWdGlIGdGlbmG
HIRoZSIBSb2Id1ZSIBXYXIZIIFINvdXIJjZVIBybyIB
OZXIQgcHIJvZHIVjdCI4NCgI0KQWI
XYJ0cyYBvZiYB0aGYIzIGY1Ic3YNhZ2YUgYXYJII
GYIkZWY50aWYNhbCYwgaGY93ZXYZIcYi
WZ4gZWZ5jb2ZRIZCZBmb3ZIgdHZJhbnZNwb3Z
J0IHZVzaWZ5nIGZRpZmZZIcmZVud
....
--_=_next_part_-506284153_=_--

1502 .... (as many as we can package at once here)

Fig. 10

1700

```
<WEAPON_COMMAND>
 <TIME_TO_FIRE>
  20041005133945
 </TIME_TO_FIRE>
 <NUMBER_OF_ROUNDS>
  5
 </NUMBER_OF_ROUNDS>
</WEAPON_COMMAND>
```

1701

```
<SENSOR_COMMAND>
 <MOVEMENT>
  <PAN>
   10.5
  </PAN>
 </MOVEMENT>
 <THROTTLE>
  <RESOLUTION>
   640x480
  </RESOLUTION>
  <DEPTH>
   8
  </DEPTH>
 </THROTTLE>
</SENSOR_COMMAND>
```

NETWORK WEAPON SYSTEM AND METHOD

This application is a continuation in part of U.S. patent application Ser. No. 10/907,825 filed Apr. 17, 2005, now U.S. Pat. No. 7,335,026, which is a continuation in part of U.S. patent application Ser. No. 10/907,143 filed Mar. 22, 2005, which is a continuation in part of U.S. application Ser. No. 10/963,956, filed Oct. 12, 2004, now U.S. Pat. No. 7,159,500, the specifications of which are all hereby incorporated herein by reference.

BACKGROUND OF THE INVENTION

1. Field of the Invention

Embodiments of the invention described herein pertain to the field of weapon systems and methods. More particularly, but not by way of limitation, these embodiments enable an operator to interact with at least one weapon and/or at least one sensor over a network such as a LAN or the Internet wherein one or more sensors may be configured to simulate a weapon and wherein weapons and simulated weapons may be integrated with a video surveillance system.

2. Description of the Related Art

A network allows multiple computers or other hardware components to communicate with one another. Networks such as a serial bus, LAN, WAN or public network are used to locally or distally couple computers or components. Public networks such as the Internet have limitations in throughput, latency and security that restrict the amount of data, time delay of the data and type of data that is sent on the public network with respect to private networks such as a LAN.

Current small arms weapons systems are not network enabled devices and to date only allow for remote firing of a single rifle at a time over a direct hardwired link. Current systems consist of a one to one correspondence between an analog user interface and a hardwired sniper rifle with a direct cable link on the order of tens of meters maximum distance between the user and the rifle. Current systems allow for a single operator to manually switch the source of video to display between a limited number of collocated and bore-aligned optical scopes each attached to a corresponding sniper rifle. These systems only allow a single user to control a single weapon at a time or view the output of a single optical scope at a time. Training utilizing these systems requires live fire and weapons that are generally significantly more expensive than a sensor device that may be utilized as a simulated weapon. When multiple threats or targets appear to a group of small arms weapons operators, a problem arises in assigning particular targets to particular operators of the weapons. Situations arise where multiple operators chose a particular target while leaving another threat un-targeted. In summary, current remotely operated weapons systems (weapon) are incapable of managing multiple simultaneous threats as there is no communication between operators or any method of analyzing or assigning weapons to targets.

A network weapon simulator system allows for remote operation of a sensor acting as a simulated weapon without requiring direct physical collocation of a user with the simulated weapon. Remotely operating a simulated weapon may include aiming the simulated weapon and firing the simulated weapon for example. To date there are no known network weapon systems or network weapon simulator systems operating over a network that allow for sensors and weapons to be transparently substituted for one another. In addition, these systems do not allow for a sensor to be utilized as a simulated weapon wherein the sensor may later be substituted for a real weapon or wherein a real weapon may be substituted for by a sensor. Current systems do not allow for multiple remote weapons and/or sensors and/or sensors configured as simulated weapons to be dynamically discovered, allocated and utilized by one or more operators. Current systems consist of limitations in mechanical and network capability that limit their use to niche situations such as sniper scenarios with no possibility of simulated weapon functionality. These systems do not allow for simulating or managing multiple simultaneous threats whether the threats themselves are simulated or real or whether the weapons themselves are simulated or real.

Furthermore, current video surveillance systems allow for the remote collection of data from sensors. These systems do not allow for integration with real weapons or for a sensor to be utilized as a simulated weapon wherein the sensor may later be substituted for a real weapon or wherein a real weapon may be substituted for by a sensor. Current surveillance systems do not allow for multiple remote weapons and/or sensors and/or sensors configured as simulated weapons to be dynamically discovered via the video surveillance system and allocated and utilized by one or more operators. Current surveillance systems do not allow for the remote control of sensors coupled with the surveillance system or for the control of sensors external to the surveillance system. Current video surveillance systems simply allow for a single operator to manually switch the source of video to display between a limited number of video cameras generally. Current video surveillance systems are therefore monolithic closed solutions that are static and cannot be augmented with real weapons, simulated weapons or integrated data and control exchange with an existing remotely operated network weapon system. These systems fail to allow for training and scenario planning in order to effectively evaluate and plan for the addition of real weapons with an existing surveillance system. Furthermore, these systems may be utilized to view multiple threats, however these systems are incapable of managing multiple simultaneous threats and assigning weapons to particular threats for example since no system or method of integrating weapons or simulated weapons into a video surveillance network exists.

Current missile systems generally allow for remote operation from a direct hardwire link. Missile systems are typically hardwired to controller stations and typically do not allow for firing in the event that the individual or hardware responsible for controlling and firing the weapon is somehow incapacitated. Missile system operators are only capable of taking control of one weapon in the system at a time and sensors are generally limited to one radar screen. There are no known missile systems capable of operation over a network that allow for the substitution of sensors for actual missiles and visa versa. There is no known method for integrating a missile system with an existing video surveillance system. Generally, missile systems assign one missile to one threat, which is a trivial problem that may be solved for instance by assigning the nearest missile to the nearest threat or a missile on the front of a ship to an incoming threat approaching the front of the ship for example. Since missiles are expensive, they are assumed be completely effective in neutralizing a threat. Hence, once a missile targets a threat, other missiles are simply assigned to other threats.

Other remote operated weapons systems include the Predator aircraft and other remotely piloted air vehicles. A Predator aircraft does not contain sensors and weapons that may be substituted for one another and does not contain simulated weapons accessible over a network. In addition, there is no way for an operator to control more than one Predator at a time or switch between a plurality of aircraft since the operator interface for a Predator includes a single view of an aircraft and is operated by a conventional pilot as if actually flying the aircraft via a ground based cockpit. There is no known method for integrating a remotely piloted vehicle with an existing video surveillance system. This type of weapon system engages one target at a time and is incapable of managing multiple simultaneous threats. When multiple remotely piloted air vehicles are in the same vicinity, the same problem arises in assigning a given threat to a particular remotely piloted air vehicle. For example, situations arise where more than one remotely piloted air vehicle target the same threat, leaving another threat un-targeted.

These systems fail to achieve maximum force multiplication allowing for a minimal number of operators to operate a maximum number of weapons. More specifically, these systems fail to utilize sensors as simulated weapons for training and scenario planning in order to effectively evaluate and plan for the addition of real weapons. Furthermore, these systems do not integrate with existing resources such as a video surveillance system. For at least the limitations described above there is a need for a network weapon system and method.

BRIEF SUMMARY OF THE INVENTION

Embodiments of the invention enable the operation of at least one weapon selected from a set of disparate weapons over a computer network such as a private network or LAN or public network such as the Internet. Weapons may be lethal or non-lethal. The system may include sensors such as a video camera or any other type of sensor capable of detecting a target. Sensors may be collocated or distantly located from weapons and there may be a different number of weapons and sensors in a configuration. Sensors may be aligned parallel with the bore of a weapon and are termed bore-line sensors herein. Sensors not aligned parallel to a weapon are termed non-bore-line sensors herein. An operator may control more than one weapon at a time and may obtain sensor data output from more than one sensor at a time using an operator user interface.

Embodiments of the invention analyze threats and assign at least one weapon to respond to the threat(s) sensed by the sensors. Analyzers are utilized to analyze the threats, assigners are utilized to assign weapons to threats and responders are utilized to operate the weapon system (whether real weapons, simulated weapons or portions of a video surveillance network are utilized). For example, more than one weapon (or simulated weapon) may be assigned to a given threat. When multiple threats appear to the system, the assignment and management of the particular weapons with respect to the particular threats is performed. Any algorithm may be utilized to assign or assist in the assignment of a weapon to a threat. For example, assigning the closest weapon to a threat or assigning an appropriate sized weapon to a threat (large gun to a vehicle threat versus a small caliber weapon to a human threat). In one or more embodiments of the invention, a user selection of a threat on a map for instance may be utilized to assign a weapon or a pick list of weapons that are capable of responding to the threat. This type of assistance greatly aides remotely operated weapons systems when there are multiple threats, multiple weapons/sensors and multiple operators.

Embodiments of the invention may also be configured to enable an operator to interact with at least one sensor configured to operate as a simulated weapon over a network. Sensors may be collocated or distantly located from actual weapons and there may be a different number of weapons, simulated weapons and sensors in a configuration. Sensors, weapons and simulated weapons may be dynamically added or removed from the system without disrupting the operation of the system. Sensors that simulate weapons are transparently interchangeable with actual weapons. Replacing sensors that simulate weapons with actual weapons allows for existing systems to upgrade and add more weapons without requiring modifications to the system, for example no additional wiring. Simulated actors and events may be injected into the system with results generated from operator gestures simulated and recorded for later analysis. For example, virtual soldiers that move or fire may be injected into the displays of operators. Injecting actors allows for simulated training without requiring live firing of weapons. An operator may control more than one weapon and/or simulated weapon at a time and may obtain sensor data output from more than one sensor at a time. Embodiments of the invention allow for the assignment of weapons or simulated weapons to threats whether simulated or real threats.

Embodiments of the invention may also be configured to enable an operator to interact with a video surveillance system including at least one sensor. The sensor may be configured to operate as a simulated weapon, or may be replaced by or augmented with a real weapon and in either case the simulated or real weapon is controlled over a network. The network may include the local video surveillance network or a network linking with a remotely operated weapon system. The integration of an existing video surveillance system with a network of remotely operated weapons and/or weapon simulators enables use of the resources of either system by the other system and enables a passive video surveillance system to become an active projector of lethal or non-lethal force. Pan and tilt cameras that exist in a legacy video surveillance system or newly added pan and tilt cameras may be utilized for real or simulated weapons, and cameras that do not pan and tilt may simulate pan and tilt functions through image processing. In addition, a video surveillance sensor may be automatically panned to follow an object targeted by the remotely operated weapon system or the remotely operated weapons may track an object that is being followed by at least one of the video surveillance sensors. Intelligent switching between sensors is accomplished when a sensor in the video surveillance system or remotely operated weapon system can no longer track an object thereby allowing any other available sensor to track an object. An operator may control more than one weapon and/or simulated weapon or video surveillance camera (that may act as a simulated weapon for example) at a time and may obtain sensor data output from more than one sensor at a time.

Weapons may include any lethal or non-lethal weapon comprising any device capable of projecting a force at a distance. An example of a weapon includes but is not limited to a firearm, grenade launcher, flame thrower, laser, rail gun, ion beam, air fuel device, high temperature explosive, paint gun, beanbag gun, RPG, bazooka, speaker, water hose, snare gun and claymore. Weapons may be utilized by any operator taking control of the weapon. Weapons may include more than one force projection element, such as a rifle with a coupled grenade launcher. Simulated weapons may include simulations of any of these weapons or any other weapon capable of projecting a force at a distance. The weapons in the system may be configured to aim at a location pointed at by a sensor whether the sensor is bore-line or not. The sensor data may be presented to the user with aiming projections from at least one weapon superimposed onto the sensor data output from at least one sensor. One or more weapons and/or simulated weapons may be aimed simultaneously by performing a user gesture such as a mouse click or game controller button selection with respect to a particular sensor data output.

The network may include any network configuration that allows for the coupling of at least one weapon, at least one sensor and at least one operator user interface over a network such as a local area network (LAN), wide area network (WAN) or public network, for example the Internet. An example network configuration for example may be implemented with a combination of wireless, LAN, WAN, or satellite based configurations or any combination thereof coupled with a public network. A second independent network may be utilized in order to provide a separate authorization capability allowing for independent arming of a weapon. All network connections may be encrypted to any desired level with commands and data digitally signed to prevent interception and tampering.

Sensors may include bore-line sensors or non-bore-line sensors. Sensors may include legacy video surveillance system cameras or other sensors that are originally installed or later added to a video surveillance system to augment the system. Example sensors include video cameras in visible and/or infrared, radar, vibration detectors or acoustic sensors any of which may or may not be collocated or aligned parallel with a weapon. A system may also include more than one sensor collocated with a weapon, for example a high power scope and a wide angle camera. Alternatively, more weapons than sensors may exist in a configuration. Sensor data output is shareable amongst the operator user interfaces coupled with the network and more than one sensor may be utilized to aim at least one target. Sensors may be active, meaning that they transmit some physical element and then receive generally a reflected physical element, for example sonar or a laser range finder. Sensors may also be passive, meaning that they receive data only, for example an infrared camera or trip wire. Sensors may be utilized by any or all operators coupled with the network. Sensors may be collocated or distantly located from actual weapons and there may be a different number of weapons, simulated weapons and sensors in a configuration. This is true whether the components reside on the video surveillance network or the network associated with a remotely operated weapon system. Sensors, weapons and simulated weapons may be dynamically added or removed from the system without disrupting the operation of the system. Sensors that simulate weapons are transparently interchangeable with actual weapons. Replacing sensors that simulate weapons with actual weapons allows for existing systems to upgrade and add more weapons without requiring modifications to the system. Use of an existing video surveillance system with a network of remotely operated weapons and/or weapon simulators allows for increased sensor coverage not provided for by the remote weapons themselves within the operator screens of the network of remotely operated weapons and/or conversely allows the integration of remotely operated sensor data onto the operator consoles of the video surveillance system. Sensors are used as simulated weapons and may be substituted with a real weapon and/or sensor or conversely a real weapon may be substituted with a sensor that may be used as a sensor or as a simulated weapon. Visual based sensors may pan, tilt, zoom or perform any other function that they are capable of performing such as turning on an associated infrared transmitter or light. Acoustic based sensors may also point in a given direction and may be commanded to adjust their gain and also to output sound if the particular sensor includes that capability.

Operators may interface to the system with an operator user interface that accepts user gestures such as game controller button presses, mouse clicks, joystick or roller ball movements, or any other type of user input including the blinking of an eye or a voice command for example. These user gestures may occur for example via a graphics display with touch screen, a mouse or game controller select key or with any other type of input device capable of detecting a user gesture. User gestures may be utilized in the system to aim one or more weapons or simulated weapons or to follow a target independent of whether sensor data utilized to sense a target is collocated with a weapon or not or parallel to the bore-line of a weapon or not. Sensor data obtained from a video surveillance system may be utilized for aiming a remotely operated weapon that may or may not be coupled directly to the local video surveillance system network. Conversely sensor data obtained from a sensor external to a video surveillance system may be utilized to aim a weapon (or simulated weapon) coupled with a video surveillance system. For bore-line sensors that are collocated with a weapon or in the case of a simulated weapon, translation of the sensor/weapon causes automatic translation of the associated weapon/sensor. The operator user interface may reside on any computing element for example a cell phone, a PDA, a hand held computer, a PC and may include a browser and/or a touch screen. Additionally, an operator GUI may include interface elements such as palettes of weapons and sensors and glyphs or icons which signify the weapons and sensors that are available to, associated with or under the control of the operator. A user of the system may control at least one weapon and receive at least one sensor data output via a browser or other Internet-connected client program or via a standalone program.

An operator user interface may be cloned onto another computer so that other users may watch and optionally record the sensor data and/or user gestures for controlling the sensors (such as pan, tilt and zoom commands) and for controlling the weapons and/or simulated weapons (such as fire, arm and explode commands) for real-time supervision or for later analysis or training for example. In addition, a video surveillance sensor may be automatically panned to follow an object targeted by the remotely operated weapon system or the remotely operated weapons may track an object that is being followed by at least one of the video surveillance sensors. Intelligent switching between sensors (which may be configured to act as a simulated weapon for example) is accomplished when a sensor in the video surveillance system or remotely operated weapon system can no longer track an object thereby allowing any other available sensor to track an object. The system may be operated over a secure communications link such as an encrypted link and may require authentication for operation of the weapon or weapons coupled with the system.

The resources included in the remotely operated weapon system or the video surveillance system (for example a memory device such as a disk drive) may be utilized in order to record the various sensor feeds and events that occur in the system with optional time stamping. Cloned user interfaces may also allow other users to interact with the system to direct or affect simulation or training exercises, such as controlling the injection of simulator actors or events, simulating the partial or full disabling of simulated weapons or operator user interfaces, scoring hits of simulated weapons on simulated hostile forces, or simulating takeover of simulated weapons or operator user interfaces by hostile forces. Triangulation utilizing sensors in a video surveillance system and/or remotely operated weapon system may be accomplished with sensors in either system and verified or correlated with other sensors in the system to obtain positions for objects in two or three dimensional space. Sensor views may be automatically switched onto an operator user interface even if the operator user interface is coupled with a video surveillance system. For example when a weapon or simulated weapon is aimed at an area, the operator user interface may automatically display the sensors that have a view of that aiming area independent of whether the sensors are external or internal to the video surveillance system. Alternatively, the operator may be shown a map with the available sensors that could cover an aim point and the user may then be queried as to the sensors desired for view. In addition, the various sensors may be controlled to follow a target, or a weapon may be directed to follow the panning of a sensor.

Operators may require a supervisor to authorize the operation of a weapon or simulated weapon, for example the firing of a weapon or simulated weapon or any other function associated with the weapon or simulated weapon. Operators may take control of any weapon or simulated weapon or utilize any sensor data output coupled with the network. An operator may take control over a set of weapons and/or simulated weapons and may observe a sensor data output that is communicated to other operators or weapons or simulated weapons in the case of autonomous operation. A second network connection may be utilized in enabling weapons or simulated weapons to provide an extra degree of safety. Any other method of enabling weapons or simulated weapons independent of the network may also be utilized in keeping with the spirit of the invention, for example a hardware based network addressable actuator that when deployed does not allow a trigger to fully depress for example. The term client as used herein refers to a user coupled with the system over a network connection while the term operator as used herein refers to a user coupled with the system over a LAN or WAN or other private network. Supervisors may utilize the system via the network or a private network. Clients, operators and supervisors may be humans or software processes. For ease of description, the term operator is also used hereinafter as a generic term for clients and supervisors as well, since there is nothing that an operator can do that a client or supervisor cannot do.

In order to ensure that system is not stolen and utilized in any undesired manner, a security configuration may disarm the weapons in the system if a supervisor heartbeat is not received in a certain period of time or the weapons in the system may automatically disarm and become unusable if they are moved outside a given area.

BRIEF DESCRIPTION OF THE DRAWINGS

The above and other aspects, features and advantages of the invention will be more apparent from the following more particular description thereof, presented in conjunction with the following drawings wherein:

FIG. 9 shows an embodiment of a multipart MIME message comprising at least one JPEG part.

FIG. 10 shows a WEAPON_COMMAND message and a SENSOR_COMMAND message in XML format.

DETAILED DESCRIPTION

A network weapon system and method will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Embodiments of the invention enable the operation of at least one weapon selected from a set of disparate weapons over a computer network such as a private network or LAN or public network such as the Internet. Weapons may be lethal or non-lethal. The system may include sensors such as a video camera or any other type of sensor capable of detecting a target. Sensors may be collocated or distantly located from weapons and there may be a different number of weapons and sensors in a configuration. Sensors may be aligned parallel with the bore of a weapon and are termed bore-line sensors herein. Sensors not aligned parallel to a weapon are termed non-bore-line sensors herein. An operator may control more than one weapon at a time and may obtain sensor data output from more than one sensor at a time using an operator user interface.

Figure 1:
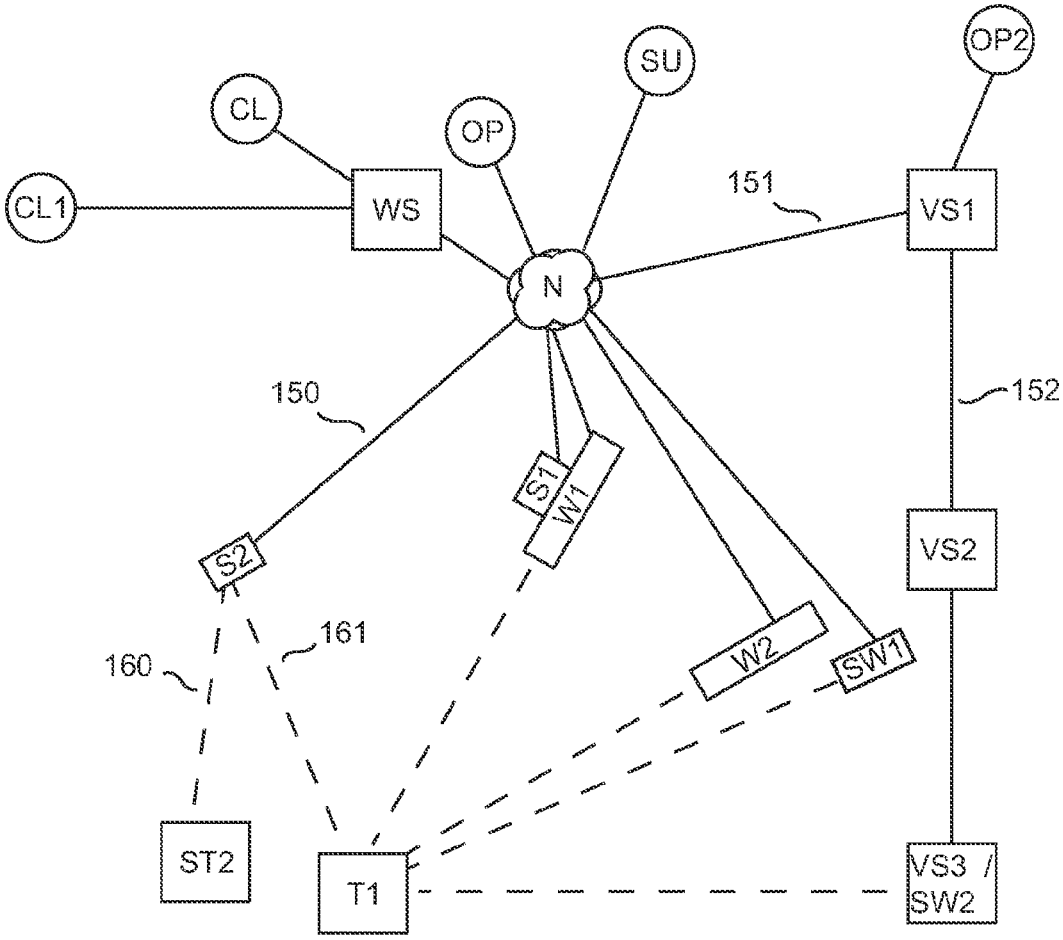
FIG. 1 shows an architectural view of an embodiment of the invention.

FIG. 1 shows an architectural view of an embodiment of the invention. Sensor S2 couples with network N via network connection 150. Network connection 150 may be connection based or include a wireless connection. Sensor S2 is in a position and orientation to "detect" a simulated target ST2 injected into the system at vector 160 and detect target T1 at vector 161. The term "detect" with reference to simulated targets that are injected into the system refers to the modification of state of a simulated weapon in order to inject a simulated target into the system that does not actually exist outside of the virtual simulation. The term "detect" with reference to an actual target refers to the actual physical detection of a real target. For simplicity the solid lines represent network connections and the dashed lines represent vectors, the majority of which are unnumbered in FIG. 1 for ease of illustration. Sensor S2 is not collocated or aligned parallel with the bore-line of a weapon. Sensor S1 is collocated with weapon W1 and is also configured parallel to weapon W1 although there is no requirement for collocated sensor S1 to be configured parallel. Sensor S1 and weapon W1 are shown directed at target T1. Simulated Weapon SW1 is a video camera capable of pan, tilt and zoom for example. This view may utilize any other representation of weapons and may be displayed with color coding to represent weapons or sensors that are available to control or may show text or other information associated with each object to represent the operator that has control of an element for example.

Video Surveillance System comprising video surveillance cameras VS1, VS2 and VS3 are shown with network connection 151 capable of communicating commands to the cameras (such as pan/tilt/zoom) and/or transferring images from VS1, VS2 and VS3 onto Network N. Network connection 151 is also capable of the inverse direction of control and data flow in that an operator user interface coupled with network 152 is capable of controlling sensor S2, weapon W2 or simulated weapon SW1 external to the video surveillance system and obtaining sensor data from the S2 and SW1. VS1 in this embodiment may include a commercially available multi-port network addressable analog to digital video converter comprising serial ports for controlling the video cameras and analog input ports for receiving analog video signals. The multi-port network video converter is communicated with over network connection 151 which is used to command video surveillance cameras VS1, VS2 and VS3 and/or obtain image data. Video surveillance camera VS3 for example may be utilized as simulated weapon SW2 and is shown directed at target T1. The multi-port network video converter may be utilized to convert weapons commands into sensor commands to simulate the operation of a weapon. Weapon W2 is directed at target T1 by an operator user interface such as used by client CL or operator OP (or supervisor SU) as per a vector at which to point obtained using the sensor data output obtained from sensor S2 and/or S1, or possibly VS1, VS2 or VS3. There is one operator OP coupled with network N in FIG. 1, however any number of operators may simultaneously interface with the system.

Operators and clients are users that are coupled with the network N with operators utilizing a standalone program comprising an operator user interface and with clients CL and CL1 interacting with the system via the Internet via browsers and/or other Internet connected program. Clients, operators and supervisors may be configured to include any or all of the functionality available in the system and supervisors may be required by configuration to enter a supervisor password to access supervisor functions. This means that a client may become a supervisor via authentication if the configuration in use allows user type transformations to occur. There is one supervisor SU coupled with network N although any number may be coupled with the system. The coupling with an operator or supervisor is optional, but is shown for completeness of illustration. A supervisor may access the operator user interface of a client or operator when the operator user interface is cloned onto the computer of supervisor SU, or supervisor SU may alternatively watch sensor data available to all operators and clients coupled with the system. Although two weapons W1 and W2, two simulated weapons SW1, SW2 and two sensors S1 and S2 are shown in FIG. 1, any number of disparate weapons and/or disparate sensors and/or simulated weapons may be coupled with the video surveillance system or via network N. For example, simulated weapon SW2 coupled with the video surveillance system may be replaced with a real weapon. Weapons W1, W2, simulated weapons SW1, SW2, sensors S1 and S2 and video surveillance cameras VS1, VS2 and VS3 may optionally include collocated microphones and loud speakers for use by operator OP, clients CL and CL1 and/or supervisor SU.

Each weapon or sensor coupled with the video surveillance system includes a sensor output and may be coupled to a serial or an addressable network interface and hardware configured to operate and/or obtain information from the coupled weapon or sensor. If configured with a serial or network interface, the interface of a sensor is used in order to accept commands and send status from a simulated weapon wherein sensor commands to the device may be utilized to operate the sensor while weapons commands to the simulated weapon may be interpreted and passed through to the sensor (for example to pan and tilt the simulated weapon, the pan and tilt functionality of the sensor is utilized) or processed as a real weapon would process them (fail to simulate a fire event if the number of simulated rounds fired from the simulated weapon has exceeded the simulated maximum round count for the weapon). It is therefore possible to use a simulated weapon as a sensor, a simulated weapon or both concurrently when configured to operate in one of these three modes. A real weapon may be substituted for the sensor and immediately begin to operate since the operator user interfaces coupled with the network detect the new weapon on the network dynamically. Embodiments of the weapon and sensor addressable network interfaces may also include web servers for web based configuration and/or communication. Web based communication may be in a form compatible with web services. Although a fully populated system is shown in FIG. 1, other embodiments of the invention may include any subset of the components shown as long as the set includes a video surveillance system that is accessible over a network through an operator user interface comprising a weapon control interface.

Initial setup of the system may begin with the coupling of weapons and/or additional sensors to the remotely operated weapon system and/or video surveillance system and network which may include in one embodiment of the invention setting the IP addresses of the weapons and sensors to unique values for example. This may involve setting the network address of an addressable network interface associated with or coupled to the weapons and sensors. Alternatively, the weapons and sensors, (or addressable network interfaces associated or coupled to them) may use DHCP to dynamically obtain their addresses. With the number of IP addresses available the maximum number of weapons and sensors is over one billion. Once the network addresses of the various weapons and sensors have been set, they may then be utilized by the operator user interfaces associated with clients CL and CL1, operator OP and supervisor SU. Other embodiments of the invention allow for the operator console associated with the video surveillance system to obtain and display sensor data obtained from the remotely operated weapons and sensors S2, S1, SW1 for example. A sensor network interface may be configured to simulate any type of weapon, switch back to operation as a sensor or alternatively operate as a sensor and accept weapon commands depending on the configuration of the sensor network interface. Video surveillance system cameras may be utilized as simulated weapons via translation of commands at the multi-port network video converter to/from the video surveillance system serial commands for controlling sensors over a proprietary serial bus for example. For video surveillance systems that include customizable commands for sensors, real weapons may be substituted for a sensor in the system or wireless communications for example may augment the serial pan and tilt commands to allow for fire commands for example to be sent directly to a real weapon coupled with the video surveillance system but not fully accessible from the network.

Figure 6:
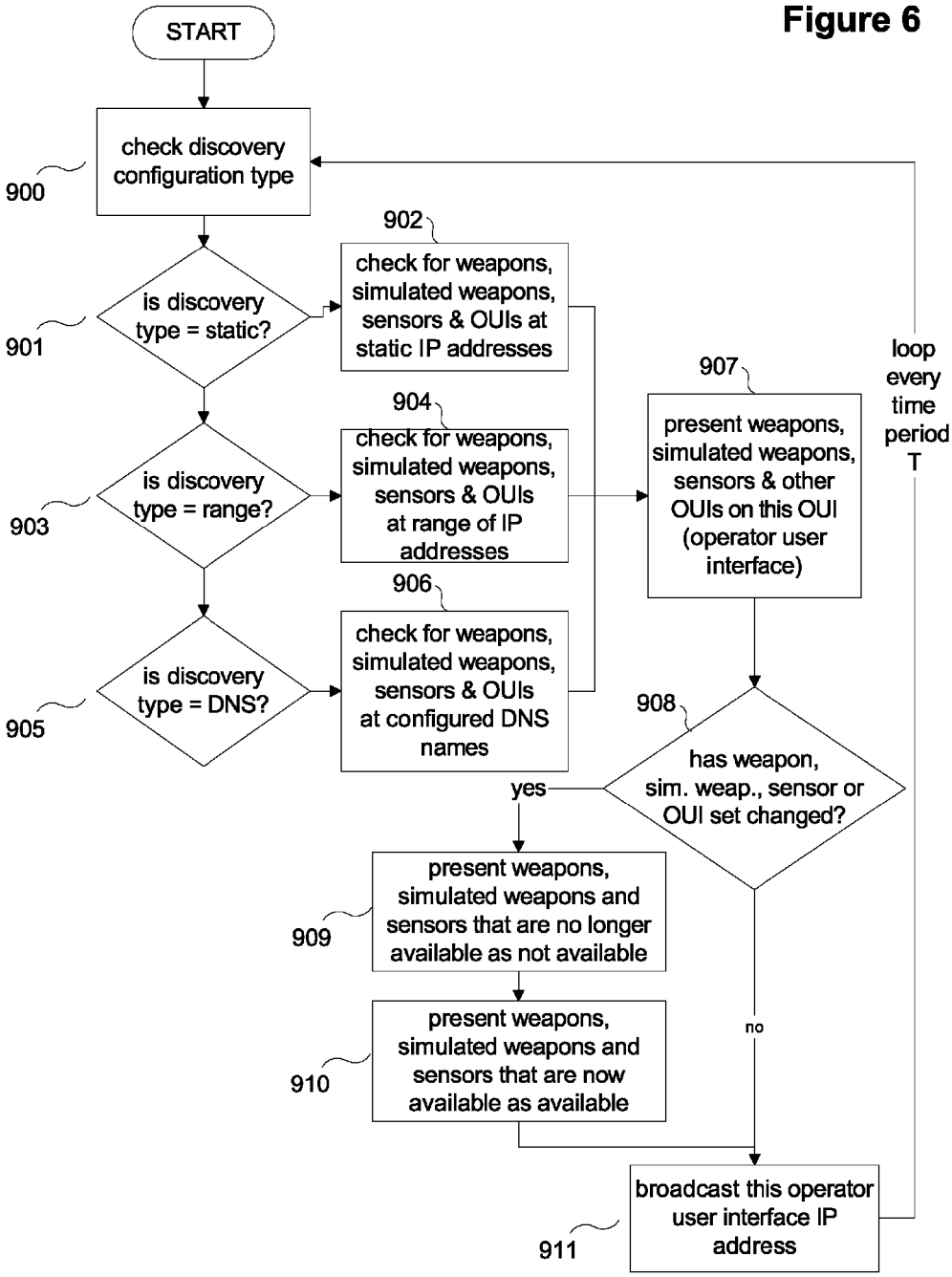
FIG. 6 shows the process of discovering weapons, simulated weapons, sensors and operator user interfaces (OUIs).

FIG. 6 shows the flow chart of the discovery process. An embodiment of the operator user interface (OUI) checks the discovery type 900 for the configuration that the OUI is attempting to couple with and if the discovery type is set to use static IP addresses 901 then the OUI checks for weapons, simulated weapons, sensors and other OUIs 902 at a specified set of IP addresses. Operators may also manually enter a set of addresses or DNS names dynamically while the system is operational in order to search for other possible weapons, simulated weapons and sensors. Alternatively, if the discovery type is set to a range of addresses 903, then the OUI checks for weapons, simulated weapons, sensors and other OUIs 904 using a range of IP addresses. For configurations with named weapons, simulated weapons, sensors and OUIs, i.e., if discovery type is DNS 905, then the OUI checks for weapons, sensors and OUIs via DNS 906. In the case of a standalone video surveillance system, an operator user interface coupled with network 152 in FIG. 1 would include obtaining a list of sensors, weapons and simulated weapons by discovering VS1 through step 902, 904 or 906. In other words, a component in the system may be discovered on the network and act as a proxy to other components on the network. Another embodiment of the invention may use any combination of these discovery types in dynamically locating weapons, simulated weapons, sensors and other OUIs. Other embodiments of the invention may use other types of name servers or directories other than DNS, and make these servers/directories available on the network. Once the weapons, simulated weapons, sensors and OUIs in the configuration have been found, they are presented on the OUI at 907. This may for example include the use of glyphs or icons, or lists thereof to graphically show the existing elements in the system, alternatively, this may involve non-visual elements such as computer generated audio. If the weapon, simulated weapon, sensor or OUI set has changed 908 then weapons, simulated weapons, sensors and OUIs that are no longer available are presented as such 909 and weapons, simulated weapons, sensors and OUIs that are now available are presented as such 910. Once the environment has been discovered and updated on the OUI, the IP address of the current OUI is optionally broadcast 911 so that other OUIs may discover this OUI without polling addresses, without checking ranges of addresses or without accessing a directory service such as DNS. Broadcasting the OUI address may also include a heartbeat that allows for other OUIs to optionally control weapons formerly controlled by the silent OUI if the configuration in use is set to allow this capability when the OUI fails to broadcast for a configurable time period. This discovery process optionally repeats at every configurable time period T. Although to this point a distinction has been made between weapons and simulated weapons, the user of the system may or may not know that a particular weapon is simulated or not. For example, in a training session, when a rifle is fired, a simulated sound and acceleration of the sensor image may cause the image to appear exactly as if obtained from a sensor mounted on a real rifle. Since a simulated weapon may appear to operate exactly as a real weapon although without actually firing or exploding, in this specification the word weapon means weapon and/or simulated weapon herein.

Heartbeat messages may be broadcast when a weapon, sensor or operator user interface is coupled with the network for example. The heartbeat message may also be sent over time and may include the network address, name of the platform, serial number or other unique key, serial number or time stamp of the last state change for the weapon/sensor and any other state information that allows for weapons, sensors or operator user interfaces to discover one another. When a state change occurs, the platform updates its heartbeat message with a new serial number/time stamp showing a change in state. Note that the broadcast heartbeat message may not be received by all interested nodes (due to packet loss tolerated by the broadcast, for example when using UDP protocol). However, each operator user interface (or Operating Station) may maintain the serial number and/or time stamp of the most recent state change of which it is aware. If the heartbeat message broadcast indicates a later state change, the Operating Station knows that it has stale information. The heartbeat message is also broadcast, so message loss of an individual heartbeat may occur. However, this broadcast is repeated so the Operating Station eventually receives it. When an Operating Station is connected to the network, it listens for heartbeat messages from Weapons Platforms. These messages are used by each operating station to build the state tree for the entire network. Once each Weapons Platform is discovered, an operating station requests full state information from each platform. The Operating Station may also wait until this state information is needed by an operator, for example if the operator selects that Weapons Platform, to ask for the full state information. An Operating Station may also poll a Weapons Platform periodically for state changes without being prompted by a fresh "state change date" or Serial Number in that platform's heartbeat message.

After the discovery process, each user may begin communicating with the weapons and sensors via an operator user interface associated with the respective client, operator or supervisor. As shown in FIG. 1, optional supervisor SU is utilizing a standalone application to access the system and does not utilize web server WS, although supervisor SU may opt to interact with the system via web server WS, this is not shown for ease of illustration. In order to select sensor data output to receive, the desired sensor icon is selected on the operator user interface (see FIG. 4). Each user of the system including operator OP, supervisor SU and clients CL and CL1 can view any or all of the sensor data. Each user of the system may control weapons W1, W2 and/or SW1 by requesting control of a weapon. Simulated weapon SW1 may appear as a real weapon (W3 for example) or in any other manner which may hide the fact that SW1 is a simulated weapon. Alternatively simulated weapon SW1 may appear with a special indication that it is simulated, although in all other respects it may function like a real weapon. Embodiments of the invention allow for each weapon to be controlled by only one user at a time although this is configurable so that an operator may take control of any other weapon, or a weapon may become available for use if a heartbeat is not received from an operator user interface for a configurable time period. For example, if a weapon loses contact with the operating station, commands that are issued that are countered eventually via another command may be auto-canceled.

In one scenario, "Pull the trigger until told to stop" may be issued and if communications with the issuing Operating Station is lost (e.g., heartbeat or other indication that the communication is lost) before the bracketing command ("Release the trigger and stop shooting") is issued, the platform aborts the command and disarms itself. Additionally, when there is a danger that other undiscovered rogues exist in the network wherein a non-desired user has control of a weapon, a Supervisor Operating Station can broadcast a "change security level" status to all the Weapons Platforms and remotely disarm the weapon. Any level or number of privileges including hierarchical privilege levels may be utilized to control or disable the weapons in the system including simulated weapons whether or not coupled with a video surveillance system.

Figure 7:
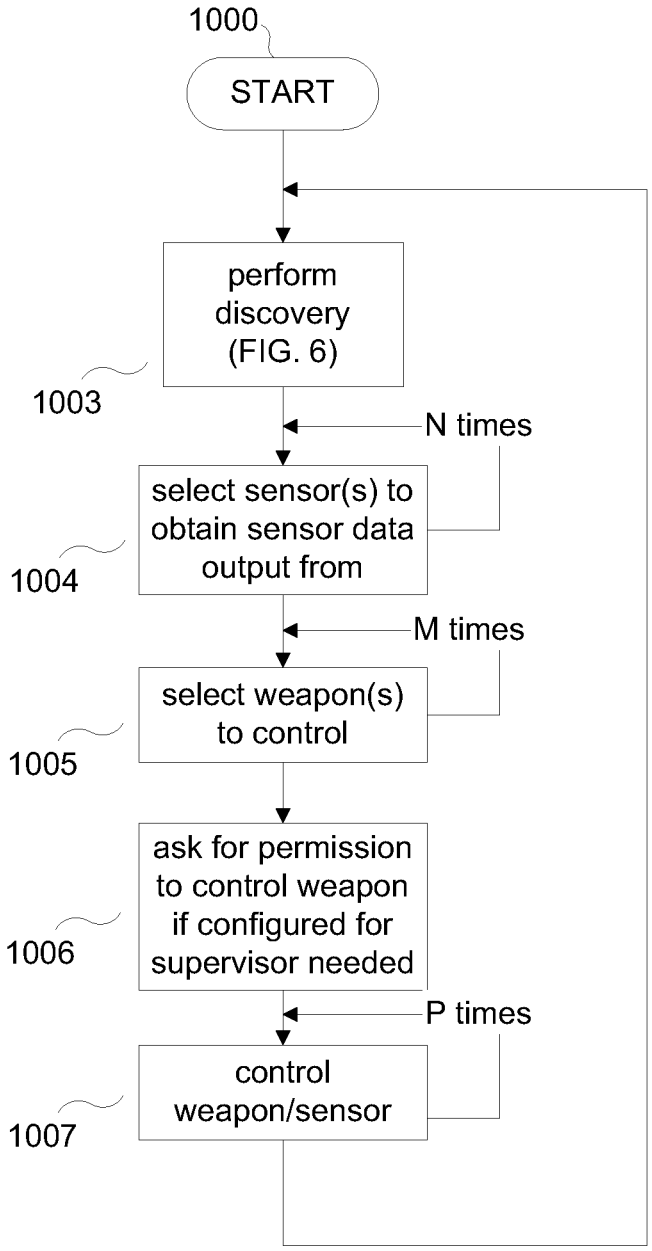
FIG. 7 shows a flowchart depicting the user interaction with the system including selection of sensors and weapons.
Figure 8:
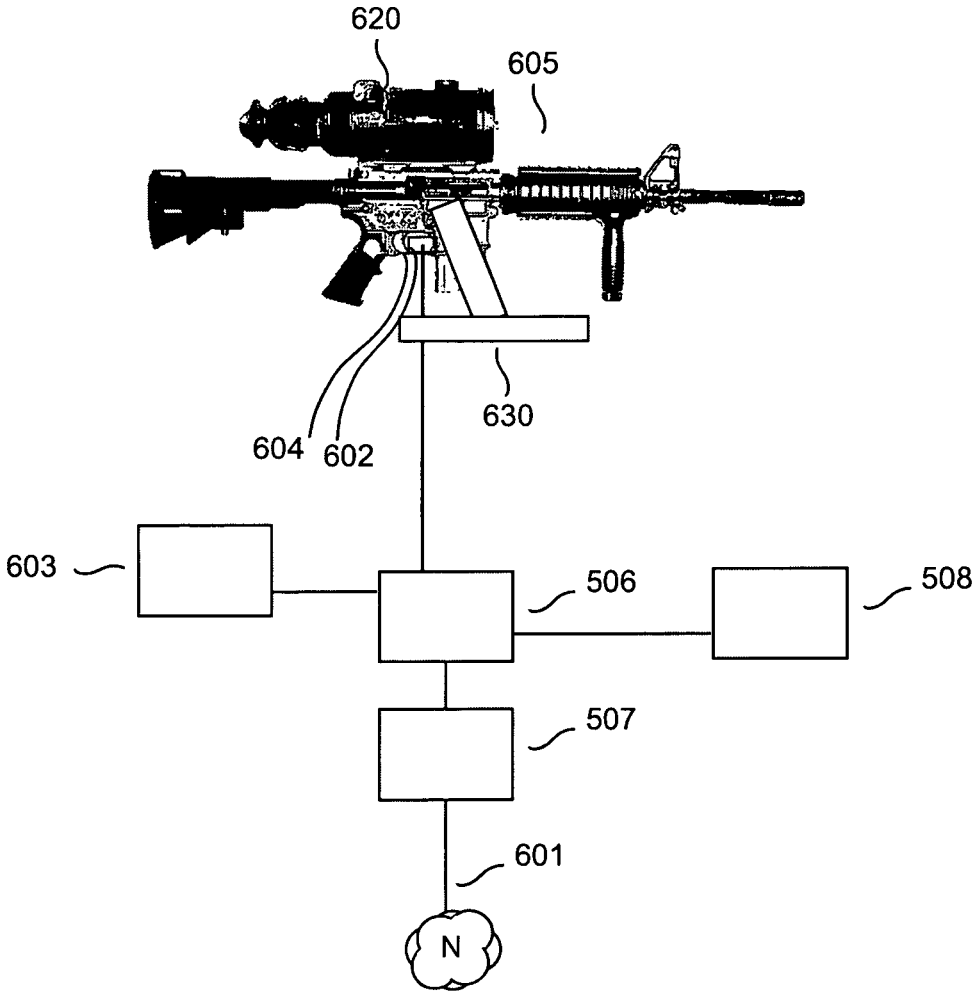
FIG. 8 shows an embodiment of the invention comprising a pan and tilt mount coupled with a weapon.

FIG. 7 shows an example interaction with an embodiment of the invention. The process of interacting with the system begins at 1000. Discovery is performed 1003 (see FIG. 6). After weapons, sensors (including video surveillance sensors) and other OUIs are discovered a user may then select a sensor to obtain sensor data output from 1004 and this may occur N times, allowing N sensors to present data to the user. The user may then select a weapon to control and this may occur M times, allowing M weapons to be controlled by the user at 1005. In addition, the M weapons may be controlled simultaneously by a single user. If the configuration in place requires supervisor permission to control a weapon, then permission is requested at 1006, however this step is optional and depends on the configuration in place. After obtaining any necessary permission, the user may control the M weapons P times, where P is a whole number and may include an upper limit set in any manner such as for example by a supervisor associated with the user. Control of the weapon may include firing the weapon, panning and tilting the weapon or any other operation associated with the weapon such as arm and disarm. A weapon or sensor may ignore a command if the weapon or sensor has been moved from an area or aligned in a direction that is not allowed by the configuration in place at the time of the received command at 1007. Disabling a weapon may include temporary disablement, permanent disablement or permanent disablement with the intent to destroy the weapon or sensor or possibly any person tampering with the weapon or sensor. As shown in FIG. 8, optional location device 508 is sampled by microcontroller 506 and if the location is deemed out of bounds as per the configuration in place, then if the configuration calls for temporary disablement, then the control weapon/sensor step 1007 is ignored. If the configuration in place specifies permanent disablement, then a non-volatile memory location may be set or cleared to indicate that no operation is to ever be delivered to the weapon or sensor. If the configuration in place specifies permanent disablement with the intent to destroy, then optional explosive device 603 in FIG. 8 is activated thereby destroying the weapon/sensor and possibly any person tampering with the weapon or sensor.

Commands and messages sent in the system to/from the weapons and sensors may be sent for example via XML over HTTP over TCP/IP, however any method of communicating commands may be utilized, for example serialized objects over any open port between an operator user interface and a weapon or sensor IP address. XML allows for ease of debugging and tracing of commands since the commands in XML are human readable. The tradeoff for sending XML is that the messages are larger than encoded messages. For example, the XML tag "<COMMAND-HEADER-TYPE> WEAPON-_FIRE_COMMAND </COMMAND-HEADER-TYPE>" includes 62 bytes, while the encoded number for this type of message element may includes one byte only, for example "0xA9"="169" decimal. For extremely limited communications channels, an encoded transmission layer may be added for translating XML blocks into binary encoded blocks. An embodiment of the invention utilizes multipart/x-mixed-replace MIME messages for example with each part of the multipart message containing data with MIME type image/jpeg for sending images and/or video based sensor data. Sending data over HTTP allows for interfacing with the system from virtually anywhere on the network since the HTTP port is generally open through all routers and firewalls. XML/RPC is one embodiment of a communications protocol that may be utilized in order to allow for system interaction in a device, hardware, operating system and language independent manner. The system may utilize any type of communications protocol as long as weapons can receive commands and sensors can output data and the weapons and sensors are accessible and discoverable on the network.

Figure 4:
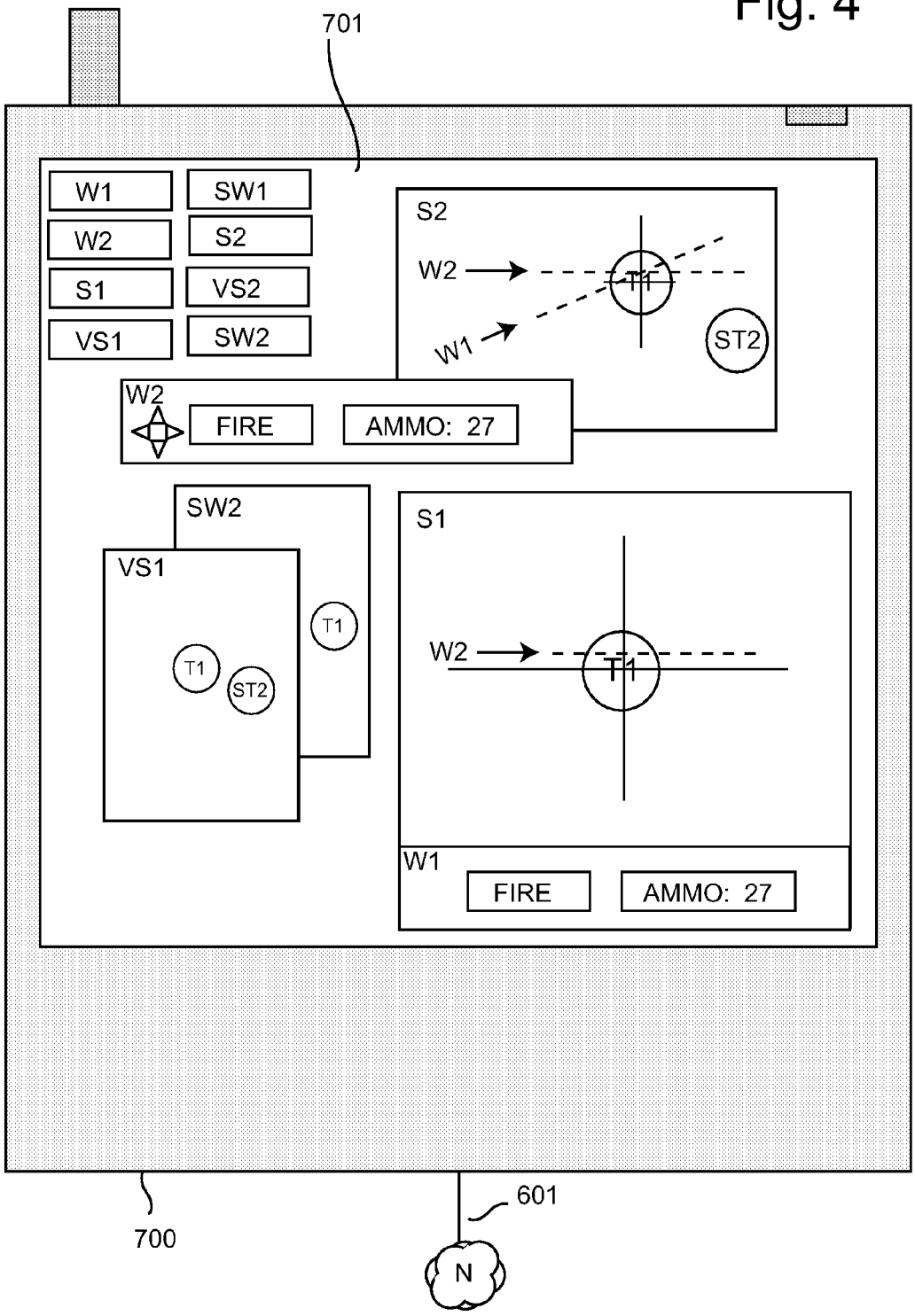
FIG. 4 shows a perspective view of an embodiment of an operator user interface.

In order for an operator to utilize a simulated weapon such as SW1, SW2 or a real weapon W1, the respective weapon icon is selected in the operator user interface and a weapon user interface is presented to the user allowing entry of commands to the weapon (see FIG. 4). Example commands include commands to pan and tilt and fire the weapon. Supervisor commands may also include commands to enable or disable a weapon or authorize the firing of a weapon at a particular target. Any type of user gesture enabling device may be used to enter commands such as a touch screen, a keyboard and mouse, a game controller, a joystick, a cell phone, a hand held computer, a PDA or any other type of input device. All user gestures and sensor data may be recorded in order to train clients, operators or supervisors or for later analysis. Training may include teaching a user to utilize the system or remotely teach a user to utilize a manually operated weapon. For example by utilizing the network and at least one weapon and at least one sensor, a user may be trained via the network weapon system to operate a non-remotely operated weapon in lieu of on-site hands-on training. By using one sensor configured as a simulated weapon, a user may be trained in use of the system without requiring the actual firing or detonation of weapons. This scenario may be used with existing video surveillance systems in order to show how a weapon located at some existing sensor location (such as a video camera for example) could be utilized. This capability allows for sales into sites configured with existing video surveillance systems. This could be used for example in order to screen possible new recruits for their understanding of firearms operation before allowing them to directly handle a weapon. For example the user may be trained on a system comprising a public network connection for eventual work at a site that has no network link to the Internet, i.e., that is LAN based.

Figure 2:
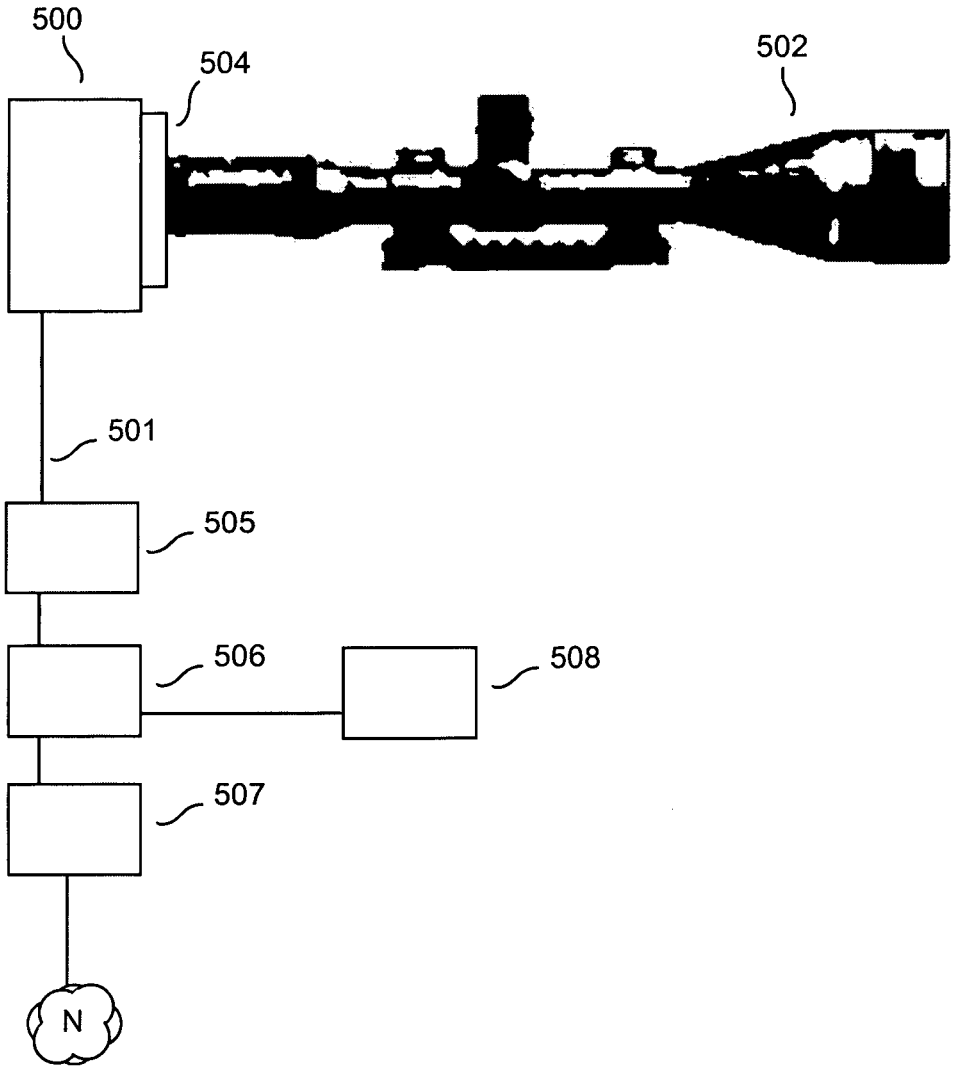
FIG. 2 shows a perspective view of an embodiment of a sensor.

FIG. 2 shows a perspective view of an embodiment of an example sensor. This sensor may also be utilized as a simulated weapon such as SW1 as per FIG. 1. Simulated weapon SW2 may utilize an existing video camera instead for example. Imaging device 500, for example a CCD imager, is coupled with optical scope 502 using flange 504. A sensor may include a visual, audio, physical sensor of any type and is not limited to a scope as depicted in FIG. 2. An embodiment of the invention may utilize any commercially available CCD imager. Imaging device 500 includes video connection 501 which couples imaging device 500 to video card 505. Video card 505 is accessed for video data by a microcontroller 506 and the video data, i.e., sensor data output is transferred out onto network N via network card 507 which includes an addressable network interface. Microcontroller 506 may also couple with location device 508 (such as a GPS device or any other location device that allows for microcontroller 506 to determine the position of the sensor). If microcontroller 506 determines that location device 508 is producing a location outside of a preconfigured operating area, then microcontroller 506 may erase a key from its non-volatile storage (i.e. flash memory) that allows microcontroller 506 to package and transmit sensor data. Location device 508 may be utilized in calculating or triangular distances to targets in combination with the pan and tilt settings of optical scope 502 for example. Microcontroller 506 takes video data from video card 505 and translates sensor data into the standard protocol(s) used by the network. The translation may include converting the image data into a MIME formatted HTTP message, or may include transmission of raw or compressed sensor data in any other format and protocol usable over the network. The type of image, i.e., the color depth, the compression used and resolution of the image may be changed dynamically in real-time in order to minimize latency and take advantage of available throughput in order to provide the best possible sensor data to the user as will be shown in conjunction with FIG. 5. Sensor 502, here shown as an optical scope may be optionally coupled with an azimuth/elevation (pan and tilt) mount. When coupled directly with a weapon, sensor 502 may be a slave to the motion the associated weapon if the weapon is itself mounted on a pan and tilt mount. Alternatively, collocated weapons and sensors may include independent pan and tilt mounts. Microcontroller 506 may include a web server to accept and process incoming commands (such as pan, tilt, zoom for example) and requests from operator user interfaces for sensor data and respond with sensor data output in the requested format with depth, compression and resolution. Microcontroller 506 may be optionally configured to communicate and provide functionality as a web service. Microcontroller 506 may also include a simulated weapon interface that translates weapons commands into sensor commands, for example a command to fire the weapon may be translated into a series of quick movements of the pan and tilt motors of the sensor in order to simulate the recoil of a rifle. Switching between simulated weapon operation and sensor operation requires knowledge of the commands available to both devices and a configuration file may be utilized to switch between the two modes of operation. Any other method of alternating between sensor and simulated weapon mode including a web service based http message, a physical switch, a command from the operator user interface or any other mechanism is in keeping with the spirit of the invention.

Figure 3:
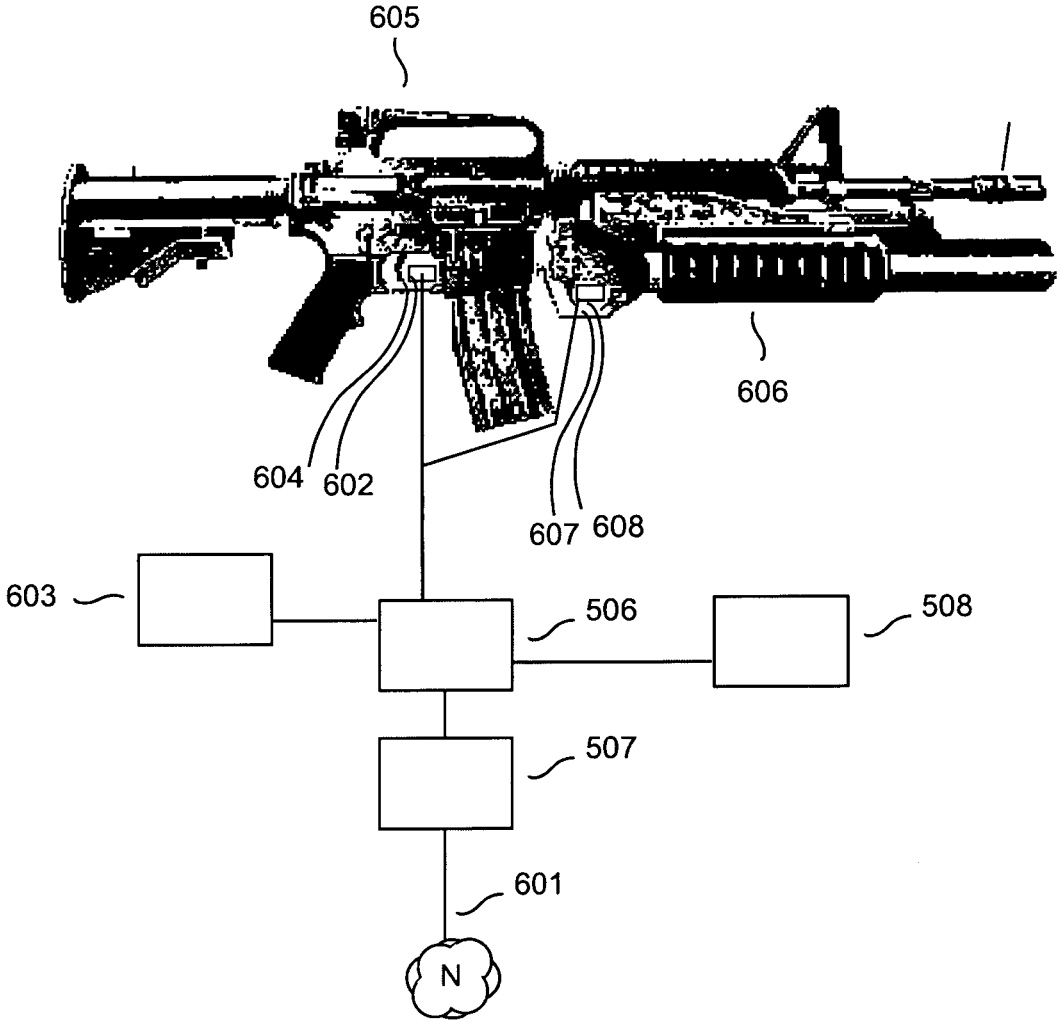
FIG. 3 shows a perspective view of an embodiment of a weapon.

FIG. 3 shows a perspective view of an embodiment of a weapon. Weapon 605 (here for example a full automatic M4 Carbine equipped with M203 grenade launcher 606) may include microcontroller 506 and network card 507 and additionally may include actuator 602 for example to depress trigger 604 for example. As the embodiment of a weapon 605 includes a second trigger 607, it also includes a second actuator 608 to depress second trigger 607. This embodiment of a weapon does not include a collocated sensor. In this example an embodiment of the weapon control interface includes two fire user interface elements. Optional location device 508 may be utilized for area based disarming when for example the weapon system is moved from its intended coverage area. FIG. 8 shows weapon 605 configured with a collocated sensor 620 that is aligned parallel with the bore of weapon 605. In this embodiment, sensor 620 is a night vision scope and weapon 605 is mounted on positioner 630 which is controllable in azimuth and elevation (pan & tilt) by microcontroller 506. Although weapon 605 has been depicted as an M4 carbine, any type of weapon may be utilized. Microcontroller 506 make include a web server to accept and process incoming commands (such as fire, pan, tilt, zoom for example) and requests from operator user interfaces for sensor data and respond with sensor data output in the requested format with depth, compression and resolution. Microcontroller 506 may be optionally configured to communicate and provide functionality as a web service. Optional explosive device 603 may include an explosive charge set to explode when weapon 605 is moved without authorization, out of ammunition or when location device 508 observes movement outside of an area. The optional explosive device may also be utilized with standalone sensors that sacrifice themselves when commanded for example a sensor coupled with a claymore providing for an explosive device that can be used to observe a target before being commanded to explode. Weapon 605 may include any type of weapon and may or may not be collocated with a sensor meaning that a sensor would not have to be destroyed if it was not collocated with the explosive coupled weapon. Each weapon or simulated weapon (whether or not part of a video surveillance system) may maintain a local copy of the state of the weapon or simulated weapon. The state may include the weapon type, ammunition count, location, pan/tilt range, list of sensors associated with the weapon or simulated weapon, the characteristics of any associated sensors, e.g., the zoom, focus settings and current status. The current status or state of the weapon may include current pan/tilt position, temperature, wind speed, relay/housing status, temperature of various subcomponents such as motors and any power, voltage or current readings and may also include an identifier associated with the current operator user interface in control of the weapon for example. In one or more embodiments, this information may be stored as in XML, for example as an XML tree. The state may be passed between nodes to ensure that no single point of failure exists.

FIG. 4 shows a view of an embodiment of an operator user interface. Operator user interface 701 runs on a computer such as computing element 700 for example a standard PC, or a PDA equipped as a cell phone operating via wireless Internet connection. Operator user interface includes user interface elements for example buttons as shown on the left side of the screen for popping up windows associated with the weapons, (including any simulated weapons that may appears designated as simulated weapons or appear designated as a weapon without reference to whether the weapon is real or simulated), sensors and video surveillance cameras. The weapons, sensors and video surveillance cameras may appear or disappear from the button group if the individual elements are added or removed from network N or from video surveillance system network 152 as per proxy VS1. With the configuration as shown in FIG. 1, and using the labels in the upper left of each window in FIG. 4 operator user interface 701 further includes windows S2, W2, S1 and W1 as a combined window, VS1 and SW2. Target T1 and simulated target ST2 may include a vehicle or person for example and are shown as circles with the reference characters T1 and ST2 inside for ease of illustration. The targets may also be shown in the individual windows with attached graphics or symbols to represent the type of target as annotated by an operator, client or supervisor or via image processing. Window S2 is a sensor display that optionally shows the projected aim points and paths of travel for projectiles fired from the various weapons in the system. For example FIG. 1 shows that weapons W1 and W2 are pointing at target T1. This is shown in window S2 as W2 and W1 with orientation pointers pointing with dashed lines added to sensor data output of sensor S2. When a weapon moves, the operator user interface obtains the movement information and redraws the dashed line to match the orientation of a moved weapon. Simulated target ST2 is shown in window S2 without any weapon pointing at it as also shown in FIG. 1 although sensor S2 may be configured to operate as a simulated weapon if desired or simulated weapon SW1 may be pointed in a direction that would allow it to "detect" the simulated target. Window S1 shows sensor output data from sensor S1 collocated with weapon W1 and therefore includes docked weapon control interface W1. Weapon control interface W1 includes a fire button and an ammunition status field. As S1 and W1 are collocated (with slight parallax since there is a slight bore-line translational displacement) a method for moving weapon W1 includes a user gesture such as clicking at a different point in window S1, or for example holding a mouse button or game controller button down and dragging left, right, up or down to re-orient the collocated weapon. Window W2 shows a four-way arrow interface that allows weapon W2 to move left, right, up or down which is then shown on displays S1 and S2 as projected aim points and or trajectories. The four way arrow may also simulate a game controller D-pad. D-pads allow input of 8 directions including the four diagonal directions. Video surveillance window VS1 and simulated weapon SW2 (which is a simulated weapon using VS3 as per FIG. 1) are shown with various targets in them and window VS2 is not shown as the user for example has not selected to view it. In the example, no weapon firing interface is associated with SW2 since it is not in the foreground although this may be altered in the configuration of the interface so that the weapon control interface is always visible for a weapon, or is docked with the corresponding simulated weapon. Any other method of showing the weapon control interface for a weapon or simulated weapon is in keeping with the spirit of the invention. An operator may alt-click on a fire button to set it for co-firing when another fire button is selected. Any other method of firing multiple weapons with one user gesture, such as another user interface element such as a window comprising links between buttons for example is within the spirit of the invention. Alternatively a game controller, joystick, or other pointing, moving, controlling device may be utilized to control operator user interface 701 displayed on a computer. In this scenario, simulated weapon SW1 may include a combined sensor weapon window such as the S1 and W1 co-joined window. Alternatively, the simulated weapon may be simulated as a weapon controller only as is shown with reference to weapon window W2. The particular choice of window for a simulated weapon may be set in any manner including but not limited to a configuration file setting. Although shown coupled with network N over network connection 601, operator user interface 701 may couple with VS1 or network 152 as per FIG. 1. This view may utilize any other representation of weapons besides buttons and any representation may be displayed with color coding to represent weapons or sensors that are available to control or may show text or other information associated with each object to represent the operator that has control of an element for example. Operator user interfaces may keep copies of the state information of each weapon and/or sensor without requiring a central repository for the state information.

Figure 5:
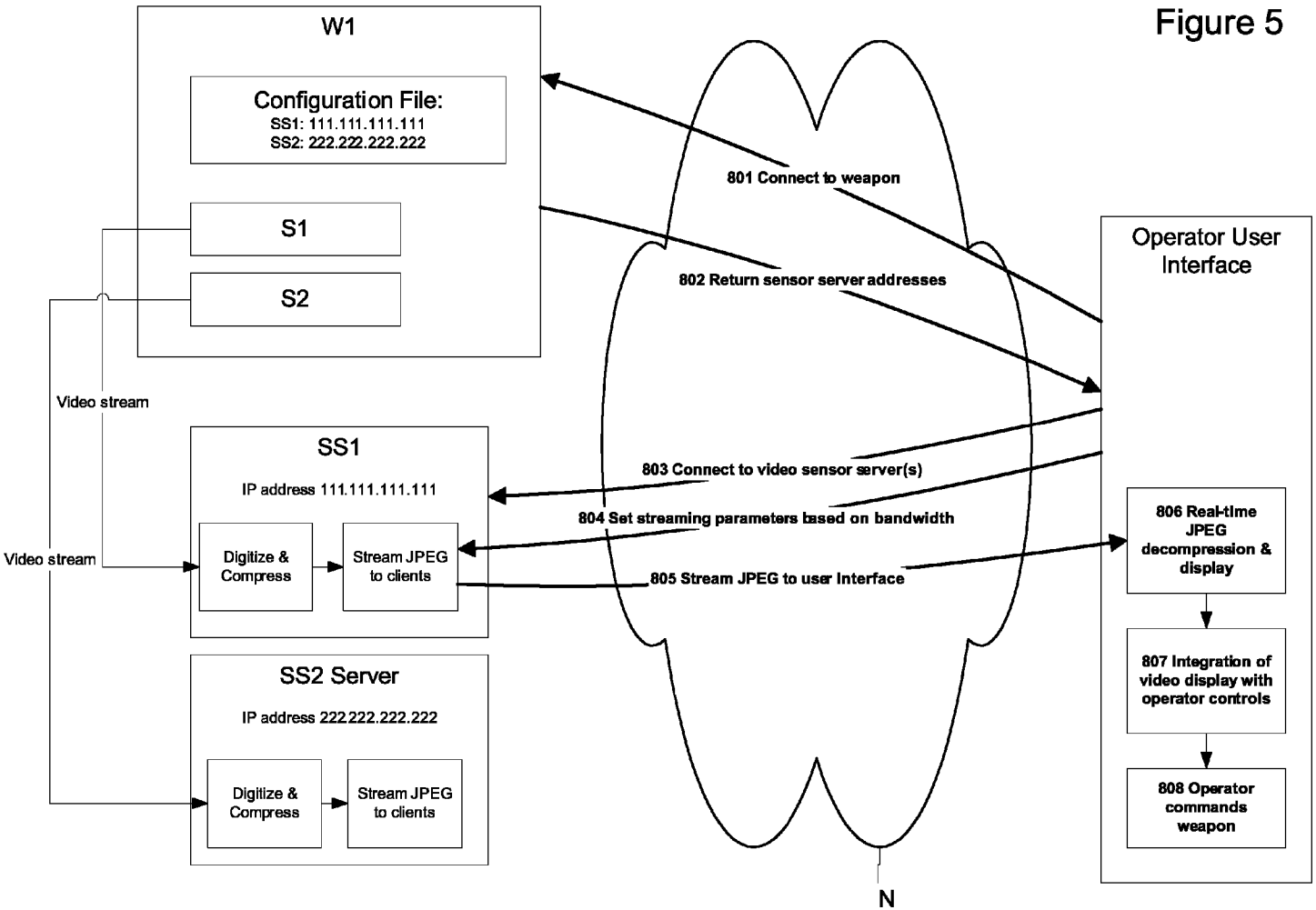
FIG. 5 shows an embodiment of the invention comprising an operator user interface, a weapon and two collocated sensors wherein sensor data is distributed over the network using a communications protocol for efficiently transferring commands and sensor data.

FIG. 5 shows an embodiment of the invention comprising an operator user interface, weapon W1 and two collocated sensors S1 and S2 wherein sensor data is distributed over the network using a communications protocol for efficiently transferring commands and sensor data. Real-time control and data distribution over a network such as the internet is difficult since networks generally include limited bandwidth wherein multiple clients may each observe different data transfer rates, blocked ports, high latency and packet loss. In order to maximize the quality of the sensor data output observed by each client, each operator user interface may be configured to allow a user to configure the sensor data output that is being received or each operator user interface may be configured to automatically negotiate the settings of the sensor data output. In order to maximize the number of clients that may access the system, ports that are generally not blocked by routers or ISPs such as HTTP port 80 or HTTPS port 443 may be utilized in order to send commands and receive sensors data within the system. In order to minimize the effects of high latency and packet loss sensor data may be displayed without being buffered or without use of existing media players that generally buffer video and audio data. As shown in FIG. 5, Operator User Interface connects to weapon W1. The IP address of weapon W1 may be preconfigured, may be polled for in a block of ranges, may be looked up in a DNS server (or any other type of directory server), may be entered by the user, or may be found in any other manner as per FIG. 6. The Configuration File shown associated with weapon W1 may include addresses for sensor servers SS1 and SS2. The Configuration File may be resident in non-volatile memory associated with the microcontroller coupled with weapon W1, or may be downloaded in any other manner. Alternatively, sensor servers SS1 and SS2 may also include preconfigured IP addresses or may be polled for in a range of addresses or may be looked up from a DNS server for example, i.e., there is no requirement for weapon W1 to be the source for sensor addresses. Sensors S1 and S2 may include built-in sensor servers that digitize and compress sensor data, for example video or audio data in which case their addresses may be directly utilized by the Operator User Interface. In one embodiment of the invention, the Operator User Interface connects 801 with weapon W1 over network N and requests any associated sensor or sensor server addresses 802. The Operator User Interface then connects 803 to sensor server SS1, which may include for example a video sensor server. Based on the observed response time in connecting 803 to sensor server SS1, or on other measurements of bandwidth, latency, or other network characteristics, parameters may be set 804 in order to account for the latency and observed throughput. Any other method of detecting the effective throughput and latency may be utilized with the system. After the sensor related parameters have been set, for example with respect to a video sensor server, and a user has requested sensor data output from the sensor SS1, sensor data for example JPEG in the case of an optical sensor is streamed to the Operator User Interface 805. In video sensor server embodiments, video streamed at 805 may include individual frames compressed into JPEG with varying compression factors based on the streaming parameters set at 804. For example, for a user connected to sensor server SS1 via network N over a high bandwidth DSL line, a large 1024×768 pixel 16 bit color image with minimal compression may be transferred at 30 frames per second whereas a user connected to the same sensor server SS1 via network N over a slow speed cell phone link may opt for or be automatically coupled with a black and 8-bit grey scale 640 by 480 pixel image with high compression to maximize the number of pictures sent per second and minimize the latency of the slower communications link. FIG. 10 shows an example XML command 1701 for a sensor that includes a pan command portion starting at line 2 of 10.5 degrees and further includes a throttle command to dynamically alter the resolution and bit depth in order to account for too few pictures per second received at the Operator User Interface. If for example a network link throughput is observed to change, a request from the Operator User Interface either manually input by the user or automatically sent by the Operator User Interface may be sent to sensor server SS1 in order to adjust the depth, resolution, compression or any other parameter associated with a type of sensor in order to optimize observed sensor data output in real-time. Depth, resolution and compression also applies to audio signals with depth corresponding to the number of bits per sample, resolution corresponding to the number of samples per second and compression corresponding to an audio compression format, for example MP3. Any format for picture, video or audio compression may be utilized in keeping with the spirit of the invention, including for example any form of MPEG or MJPEG video compression. When sending picture or video data over HTTP or HTTPS for example, images may be encoded with multipart/x-mixed-replace MIME messages for example with each part of the multipart message containing data with MIME type image/jpeg. FIG. 9 shows an embodiment of a multipart message comprising a descriptive header 1500 that is optional, a first jpeg image 1501 encoded in base64 and a subsequent "next part" that may include as many images or sound clips as are packaged for transmission in this MIME message. After the Operator User Interface receives the sensor data, the sensor data is decompressed 806 and shown on the Operator User Interface 807. Generally available media players buffer data thereby greatly increasing latency which is undesirable for weapons related activities. Any media player constructed to minimize latency may be coupled with the system however. When observing sensor data a user may instruct the weapon control interface portion of the Operator User Interface to fire a weapon or perform any other operation allowed with respect to the weapon 808 for example such as pan and tilt. When sending commands to weapon W1, the commands may be sent in XML in any format that allows weapon W1 to parse and obtain a command, or may be sent in binary encoded format for links that are low bandwidth and/or high in latency in order to maximize utilization of the communications link. FIG. 10 shows an example XML weapon command 1700. The command includes a time at which to fire and a number of rounds to fire for example. The command may also include for example pan and tilt elements that to control the pan and tilt of a weapon. Use of image and audio compression from the sensors that may change dynamically as the communications link fluctuates along with the transmission of XML or encoded binary to the weapons that may also optionally switch formats dynamically to account for fluctuating communications link characteristics yields control that is as close to real-time as is possible over the network. Note that the XML messages and MIME message are exemplary and may include any field desired. Although weapon command 1700 includes weapon specific commands, a sensor acting as a simulated weapon may include a software module that translates the commands into sensor specific commands. For example, weapon command 1700 may cause 5 tilt command pairs to simulate recoil of a real weapon wherein each of the 5 rounds specified to be fired as per weapon command 1700 may be implemented with a simulated weapon as a tilt up and down, repeated once for each round fired in a simulated manner.

As each user interacts with an operator user interface that is addressable on the network, a supervisor may clone a given user's operator user interface by either directly coupling with the computer hosting the operator user interface and commanding the operator user interface to copy and send input user interface gestures and obtained sensor data output to the supervisor's operator user interface as a clone. Alternatively, the supervisor can obtain the sensor list and weapon list in use by the operator user interface and directly communicate with the sensors and weapons controlled by a given user to obtain the commands and sensor data output that are directed from and destined for the given user's operator user interface. Any other method of cloning a window or screen may be utilized such as a commercially available plug-in in the user's PC that copies the window or screen to another computer.

By cloning an operator user interface and providing feedback from an observer, monitor, trainer, teacher or referee to a user that is currently utilizing the system or by recording the user gestures and/or sensor data output as viewed by a user real-time or delayed training and analysis is achieved. The training may be undertaken by users distantly located for eventual operation of an embodiment of the invention partitioned into a different configuration. The training and analysis can be provided to users of the system in order to validate their readiness and grade them under varying scenarios. The clients may eventually all interact with the system as operators over a LAN for example or may be trained for use of firearms in general, such as prescreening applicants for sniper school. By injecting actual or simulated targets into the system, clients may fire upon real targets and be provided with feedback in real terms that allow them to improve and allow managers to better staff or modify existing configurations for envisioned threats or threats discovered after training during analysis.

A sensor may include a video camera for example and the video camera may include a pan, tilt and zoom mechanism. For sensors that do not include a pan and tilt mechanism, the pan and tilt functions may be simulated by displaying a subset of total video image and shifting the area of the total video image as displayed. Similarly, zoom may be simulated by showing a smaller portion of the video image in the same sized window as is used for the total video image.

The operator user interface may simulate the firing of the simulated weapon, or the processor associated with the simulated weapon may simulate the firing of the simulated weapon. The simulated firing of the weapon may include modification of ammunition counts, display of flashes and explosive sounds injected into the sensor data output, or created on the operator user interface. The sensor data output may also include an overlay of a scope sight such as a reticle. The simulated weapon may also allow for simulated arming and disarming events and may simulate the opening and closing of a weapon housing by transitioning the video from dark to normal for example. The simulated weapon may also be disabled or taken over by a supervisor to simulate a compromised weapon for example.

The system may also allow for injection of actors and events into the system. For example, a software module may superimpose targets onto a sensor data output that is then observed on the operator user interfaces showing the sensor data output. When a user fires upon a simulated actor or responds to a simulated event the resulting simulated hit or miss of the target may be generated from the processor associated with the sensor or with the operator user interface associated with the user gesture. The event and simulated result may then be shared among all of the operator user interfaces and sensors in the system in order to further simulate the result on with respect to any other sensor having the same coverage area as the first sensor where the simulated event takes place.

Figure 11:
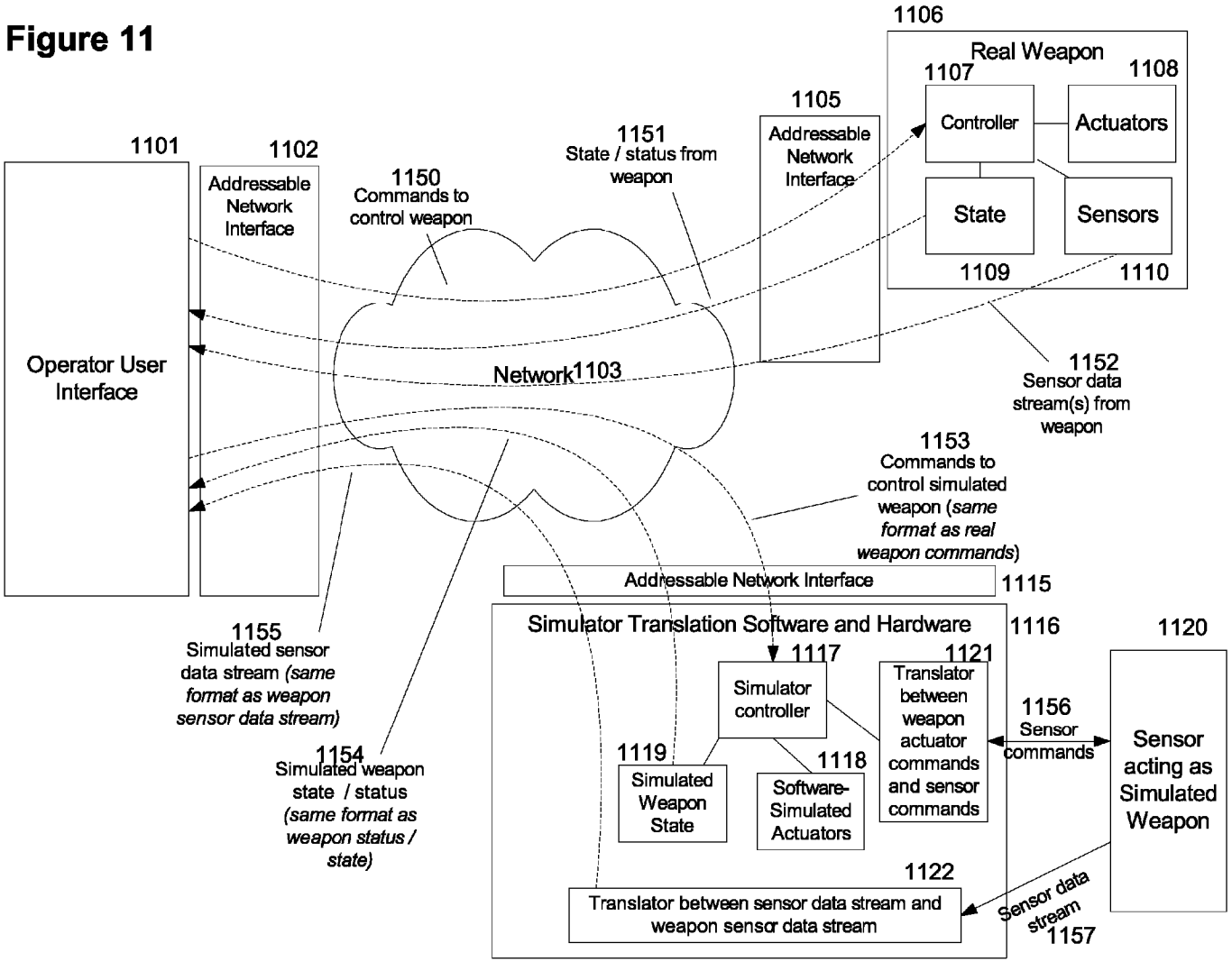
FIG. 11 shows an embodiment of an architectural view of the system.
Figure 15:
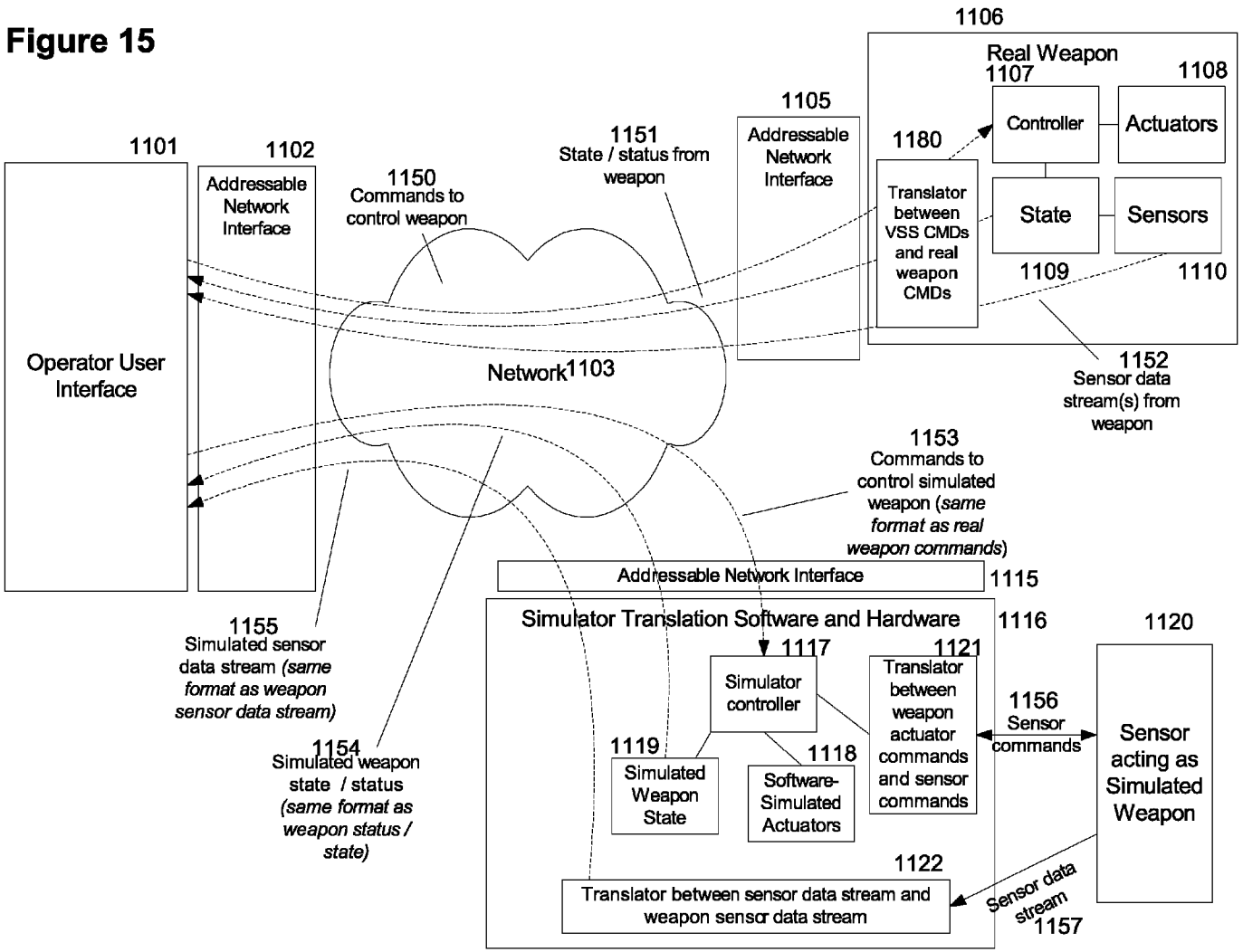
FIG. 15 shows an architectural view of the system comprising a real weapon coupled with the video surveillance system.

FIG. 11 shows an embodiment of an architectural view of the system. Operator user interface 1101 communicates via addressable network interface 1102 through network 1103 to real weapon 1106 (having controller 1107 coupled with actuators 1108, state 1109 and sensors 1110 wherein sensors 1110 provides sensor data stream(s) from weapon 1152 to operator user interface 1101) and sensor acting as simulated weapon 1120 via addressable network interfaces 1105 and 1115 respectively. Network 1103 may be local or external to the video surveillance system. Network interface 1115 may reside on the front of a multi-port network video converter in order to convert commands 1153 into sensor commands 1156 specific to the video surveillance system to allow for simulation of a weapon. In the case of communicating with sensor acting as simulated weapon 1120 commands destined for the simulated weapon arrive at addressable network interface 1115 and are forwarded to simulator controller 1117. Simulator controller 1117 directs translator 1121 to translate weapon commands 1153 into appropriate sensor commands 1156, for example to simulate the firing of a weapon, the sensor may produce some movement to simulate a recoil. Translator 1121 may be disabled programmatically or automatically when switching out sensor 1120 with a real weapon. Software simulated actuators 1118 may act to digitally pan a non-pan and tilt sensor for example by adjusting the area of the video image returned via simulator translation software and hardware 1116. Translator 1122 provides a data weapon stream 1155 from the simulated sensor data stream via input sensor stream 1157 for example to overlay a crosshair or reticle on top of the sensor data. Simulated weapon state 1119 allows for non-sensor data such as shots-remaining to be decremented each time a fire command is received, thereby failing to simulate a fire event when no simulated ammunition remains. Simulated weapons status 1154 is provided from simulated weapon state 1119 upon request or via event change or via status updates at desired times. In this architecture, operator user interface 1101 sends the same commands 1150 to control a weapon as the commands 1153 to control the simulated weapon 1120, noting again that that commands may be directed to a real weapon if sensor 1120 is switched out for a real weapon. In addition, status 1151 from real weapon 1106 is in the same format and therefore undistinguishable from status 1154 returned from the simulated weapon. In this manner, pan and tilt cameras for example may simulate real weapons. When a real weapon is desired for a particular location for example, the sensor may be interchanged (or augmented with) a real weapon without modifying any software within the system. The operator user interface may be configured to hide or show the fact that sensor 1120 is acting as a simulated weapon or not. FIG. 15 shows an architectural view of the system comprising a real weapon coupled with the video surveillance system. Translator 1180 converts commands arriving at a multi-port network video converter front end for a video surveillance system for example to be converted into real weapon commands. For commands such as "fire" that do not exist over the video surveillance system bus, the weapon may include a wireless connection for obtaining commands that are not transmittable over the video surveillance system bus. For video surveillance system busses that allow customized messages, then commands may be sent directly to the weapon over the existing bus. For installations that allow for additional wires to be added to a video surveillance system, then the real weapon configuration in FIG. 11 allows for the real weapon without the translator to be added to the video surveillance system. As operator user interface 1101, real weapon 1106 and simulated weapon 1120 may be local or external to the video surveillance system a robust and extensible system that makes use of an existing video surveillance system is achieved with this architecture.

Figure 12:
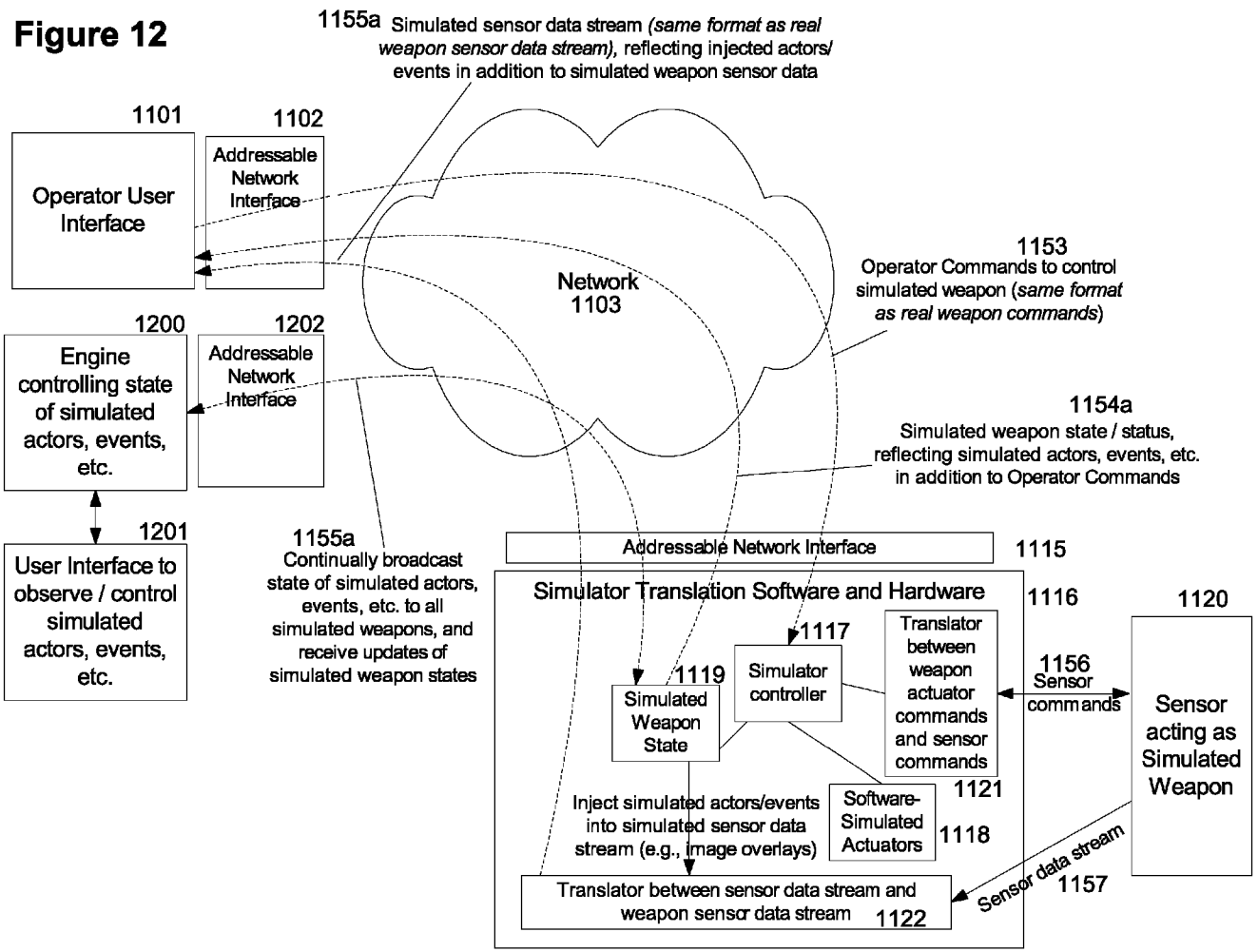
FIG. 12 shows an alternate embodiment of the invention comprising an engine configured to inject and control simulated actors and events into the system.

FIG. 12 shows an alternate embodiment of the invention wherein engine 1200 may inject and control the state of simulated actors and events into the system. The injection of simulated combatants for example occurs via engine 1200 over addressable network interface 1202 in order to alter simulated weapon state 1119. The alteration of simulated weapon state 1119 may occur directly or via simulator controller 1117 (not shown for ease of illustration). The altered simulated weapon state includes injected actors and events that are overlaid onto the sensor data stream 1157 to produce weapon data stream 1155*a*. The altered status 1154*a* is obtained or broadcast from simulated weapon state 1119 and includes any injected actors or events. A user interface 1201 is utilized to control and observe the simulated actors, events and simulated weapon data stream if desired (not shown for brevity).

Figure 13:
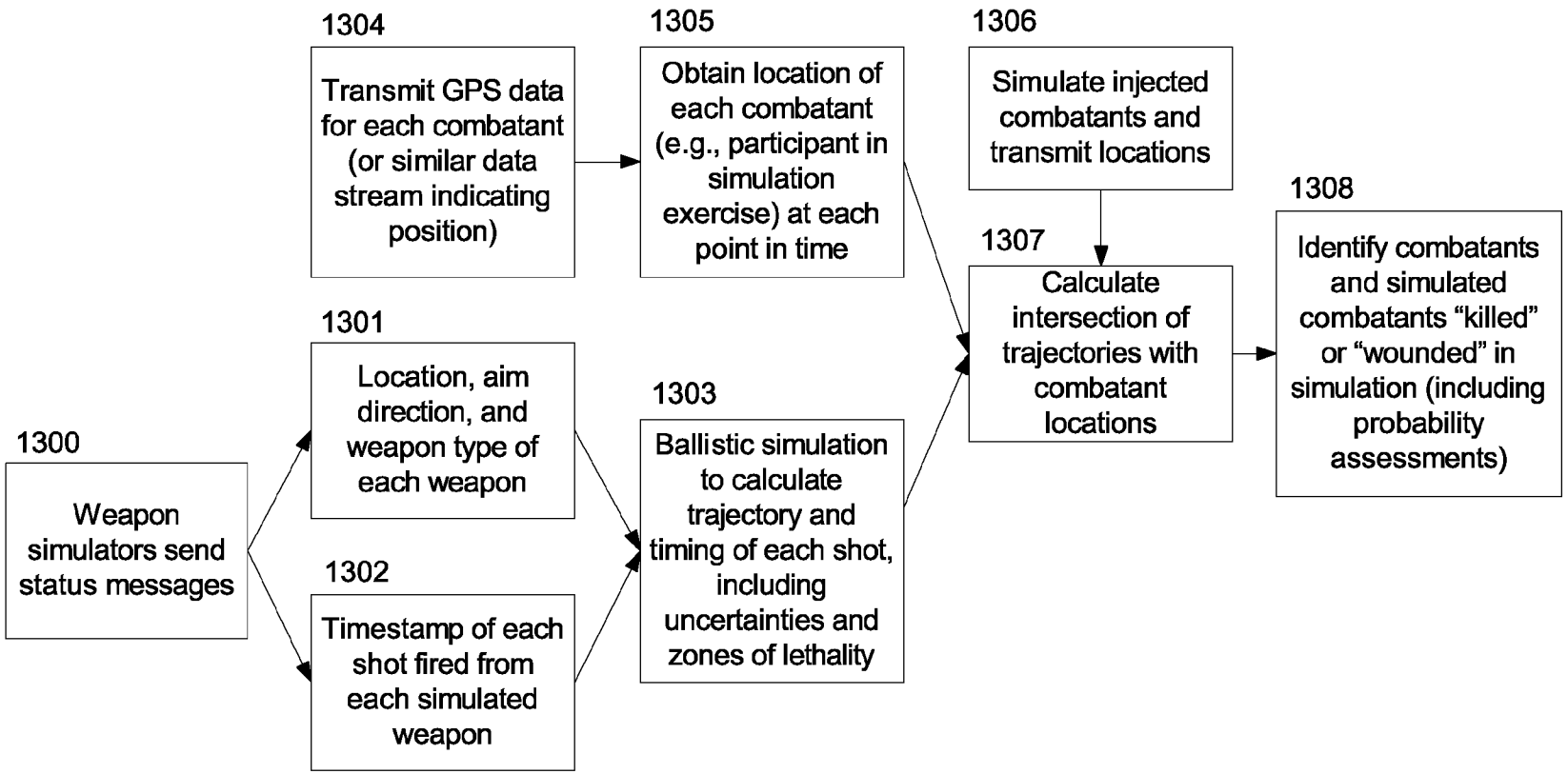
FIG. 13 shows the flow of data and processing in the system.

FIG. 13 shows the flow of data and processing in the system. Weapon simulators send status messages (or are polled) at 1300. The status messages may include location, aim, direction and weapon type for each real or simulated weapon at 1301. Time stamping may occur at 1302 for events that benefit from time stamping such as fire events. Ballistic simulation to calculate the trajectory and timing of each shot based on the status messages is performed at 1303. During the time period when the weapons and weapon simulators are sending status messages, the combatants wearing GPS receivers for example are transmitting their location data at 1304, which is obtained at 1305 and time stamped. Any simulated combatants that have been injected into the system include location and timing data that is distributed throughout the system at 1306. The intersection of the simulated and real combatants and any trajectories as calculated at 1307 are correlated and any combatants or simulated combatants that are killed or wounded are identified at 1308.

Figure 14:
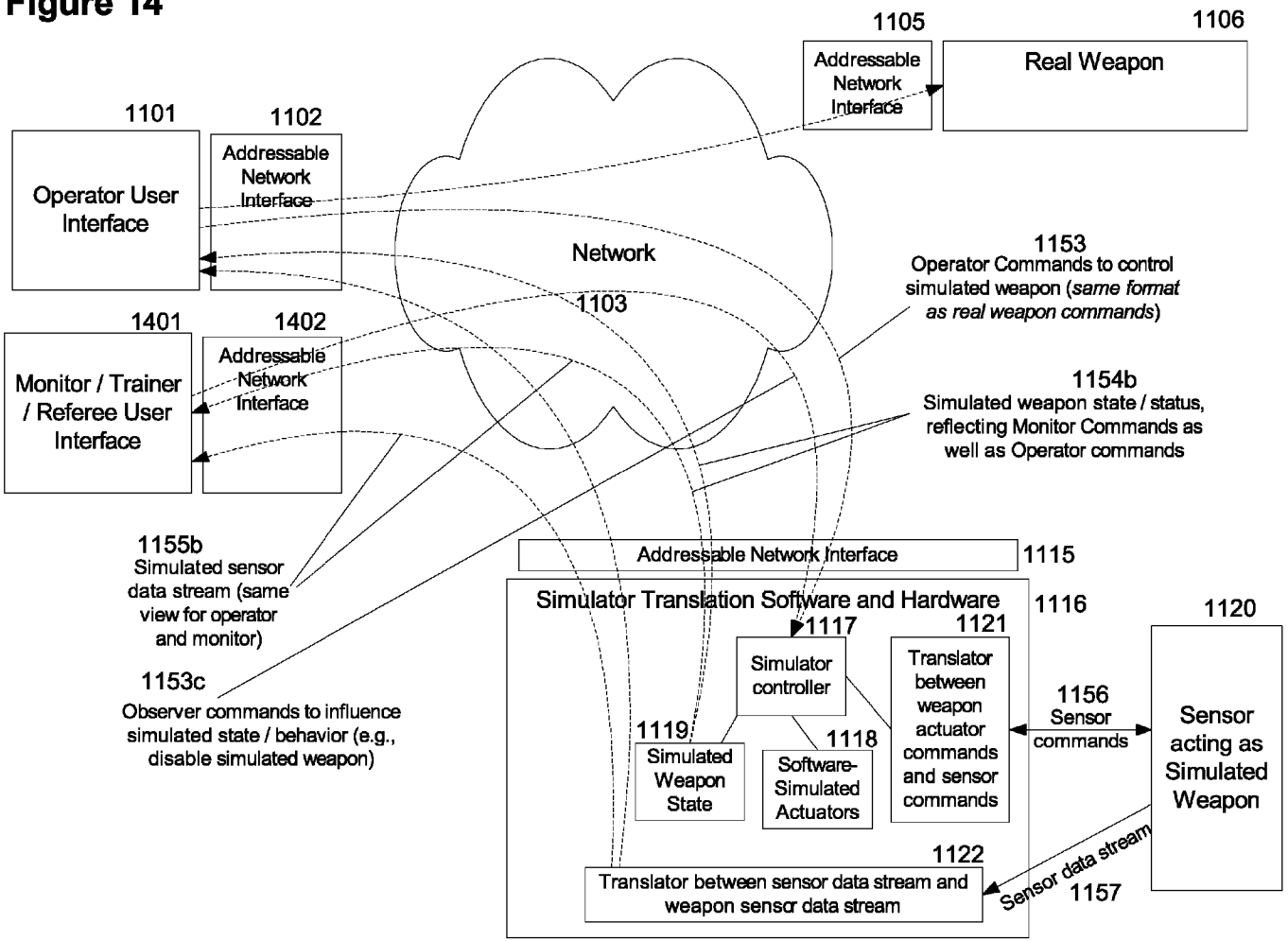
FIG. 14 shows an embodiment of the invention comprising a monitor, trainer, teacher or referee user interface.

FIG. 14 shows an embodiment of the invention comprising a monitor, trainer, teacher or referee user interface 1401 operating over addressable network interface 1402 that may also control sensor acting as simulated weapon 1120 via commands 1153*c* or observe simulated weapon state 1119 via simulated weapon state/status 1154*b* or observe weapon data stream from translator 1122 as simulated sensor data stream 1155*b*. In this scenario, the monitor can do anything that an operator can do plus alter the state of the real weapon for example to disable it, or set the simulated weapon state for example to have a certain amount of ammunition that is then observed by operator user interface 1101.

Figure 16:
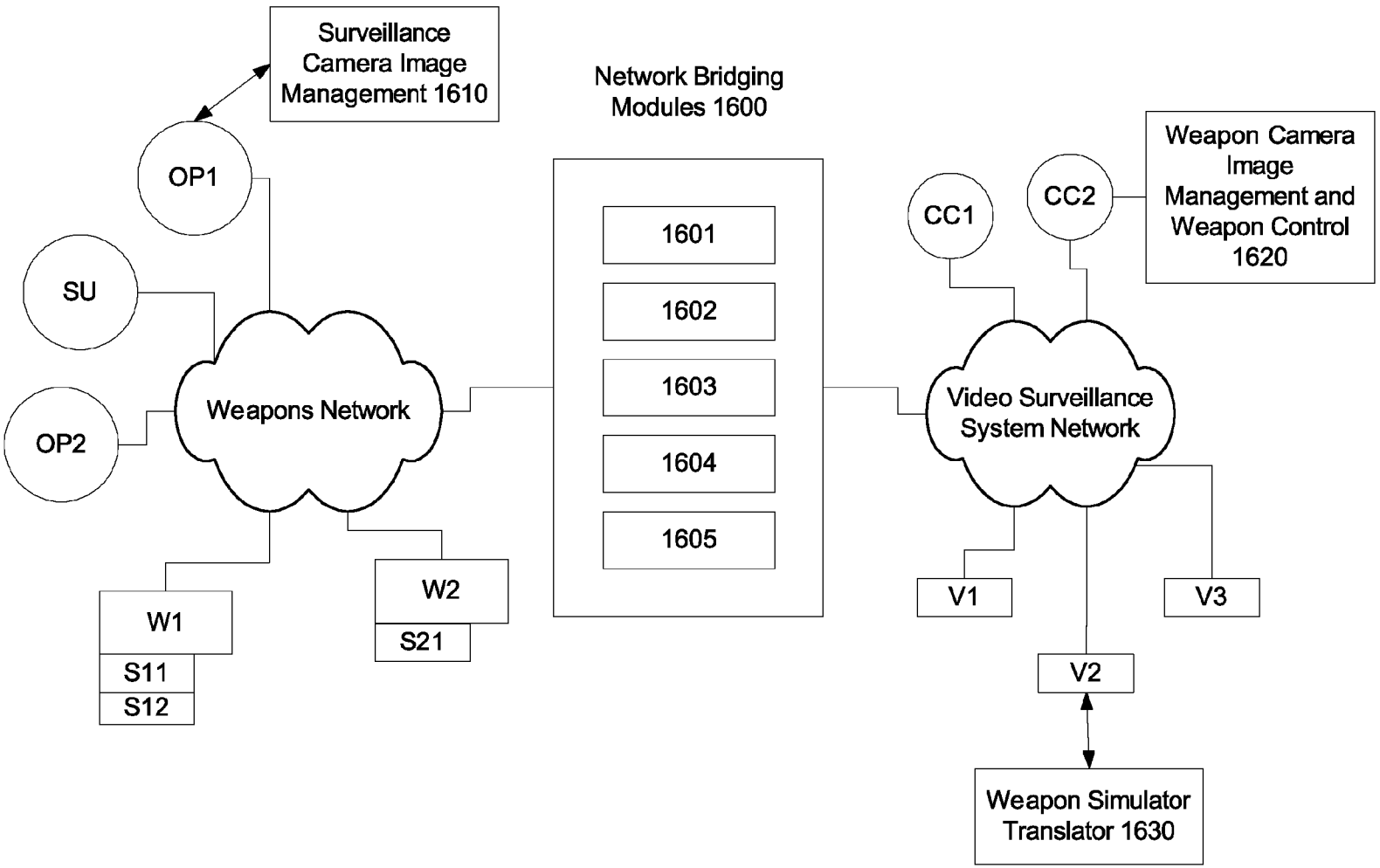
FIG. 16 shows another embodiment of the architecture of the system showing modules allowing for the integration of a video surveillance system with a remotely operated weapons network.

FIG. 16 shows another embodiment of the architecture of the system showing modules allowing for the integration of a video surveillance system with a remotely operated weapons network. FIG. 16 shows an architectural diagram of an embodiment of the invention. A remote weapons network exists wherein operators (OP1 and OP2) and supervisors (SU) can communicate with and control one or more remotely operated weapons (W1 and W2). The installation utilizes a commercially available video surveillance network wherein control center operators (CC1 and CC2) can receive and display video images from video surveillance cameras (V1, V2, and V3), and can potentially control these cameras (e.g., using pan/tilt/zoom controls). The two networks are logically independent unless coupled via one or more embodiments of the invention.

Several modules comprising network bridging module 1600 are provided to logically bridge between the two networks, including routing module 1601. Routing module 1601 enables messages to be routed from an operator station such as OP1 to a specified video surveillance camera such as V1, or from a video control center station such as CC1 to a remote weapon such as W1. The routing module may be a combination of hardware and software. Note that if both networks (the weapons network and the video surveillance network) use compatible addressing and routing schemes, for example if both are TCP/IP networks, then the routing module may be a standard router. However in general the networks may be incompatible and require specialized, customized hardware and/or software for network bridging. For instance, the video surveillance network might not be a packet-switched network at all, but may utilize dedicated serial links to each camera. In this case the routing of a message from a weapon operator OP1 to a surveillance camera V1 may include sending a message first to a central camera control system, and then forwarding that message on the selected serial line to the appropriate camera.

Discovery module 1602 allows weapons operators such as OP1 to identify the specific video surveillance cameras (such as V1) available on the video surveillance network, and conversely allows a video control center station such as CC1 to identify the specific remote weapons available on the weapons network. In the simplest case this module may include a centralized directory of weapons, a centralized directory of surveillance cameras, and/or querying tools to allow each network to retrieve information from each directory. More complex discovery modules are also possible, such as discovery modules that listen for broadcast messages sent from each weapon (or each surveillance camera) to identify the set of active nodes on the network.

Control protocol translation module 1603 provides a bidirectional translation between weapon control commands and camera control commands. It allows weapons operators such as OP1 to issue commands to cameras that are similar to the control commands issued to remote weapons. This simplifies integration of the video surveillance camera images and controls into the weapons operator user interface. For example, in one embodiment of the invention, remote weapons are controlled via XML-formatted commands. A command to pan and tilt a remote weapon continuously at a specified pan and tilt speed might have the following format:

```
<command id="move-at-speed">
<parameters>
<parameter id="pan-speed">37.2</parameter>
<parameter id="tilt-speed">23.1</parameter>
</parameters>
</command>
```

In one embodiment of the invention, commands that control video surveillance cameras are serial byte-level commands in a vendor-specific format determined by the camera vendor. For example, a camera command to pan and tilt a camera at a specified pan and tilt speed might have the following format in hexadecimal:

8x 01 06 01 VV WW 01 02 FF.

Where x is a byte identifier for a specific camera, VV is a pan speed parameter, and WW is a tilt speed parameter. The protocol translation module maps commands from one format to the other to simplify system integration. Note that this module may include a set of callable library routines that can be linked with operator user interface software. This module also works in the reverse direction, to map from camera control command format to weapon control command format. This mapping allows video surveillance control center software to control weapons using commands similar to those used to control video surveillance cameras.

Video switching and translation module 1604 routes and potentially converts video signals from one network to another, so that the video can be used by receiving operator stations or video surveillance command centers in the "native" format expected by each of those entities. For example, in one embodiment of the invention, the remote weapon network uses an IP network to deliver digitized video in MJPEG format. In this embodiment, the video surveillance network uses analog video, circuit-switched using analog video matrices. To integrate these systems, this embodiment of the invention may include a digital video server, a switching module, a digital-to-analog converter. A digital video server may be coupled to one or more of the output ports of the analog video matrix of the surveillance network. The video server converts the analog video output from the video matrix into MJPEG format, and streams it over the IP network of the remote weapons network. A software module may be added that controls the switching of the analog video matrix, which accepts switching commands from an operator station on the remote weapons network, and translates these switching commands into commands that switch the selected video stream onto one or more of the analog video output lines from the video matrix that are attached to the digital video server. A digital-to-analog converter may be coupled with the IP network of the weapons network, which receives selected MJPEG video streams and converts these streams to analog video output. The output of the digital-to-analog converter is connected as an input to the analog video matrix, so that this output can be switched as desired to the appropriate receiver channel in the video surveillance network.

Other types of video translation and switching can be performed, based on the particular types of routing and video formats used in each network. For example, if both the weapons network and the video surveillance network use IP networks for routing, but the weapons network uses MJPEG format and the video surveillance network uses MPEG-4 format, then the video switching and translation module may be utilized to convert between MJPEG and MPEG-4 formats.

Location and range querying module 1605 provides information about the location and effective range of each remotely operated weapon and each video surveillance camera. It also provides an interface that allows each operator station or video surveillance control center to query the information. In the simplest embodiment, this module contains a database with the necessary information for each weapon and surveillance camera. More complex implementations may be employed, for instance one embodiment might query an embedded system collocated with a weapon or a video surveillance camera to retrieve data on location and range dynamically. The information provided by this module allows the user interface software for weapons operators and video surveillance control centers to intelligently select and display data and video streams from weapons or cameras in a particular area. For example, a weapons operator user interface might display video surveillance images from cameras that are in range of the area in which a remote weapon is currently aiming; to determine which cameras are in range, the weapons operator user interface may query the information from this module.

Surveillance Camera Image Management 1610 may be used to extend the user interface and control software in weapons operator stations (e.g., OP1). The operator weapons interfaces are thus extended to incorporate management and display of video surveillance images into the operator user interface. These functions utilize the network bridging modules 1600 as described above. With the function of the bridging modules available, the operator stations can provide many addition features to weapons operators, including display of proximate surveillance camera images along with weapons camera images on the same operator user interface, manual control of proximate surveillance cameras from operator user interfaces and automated selection, display and control of video surveillance images in order to synchronize the movement of remote weapons.

For example, using the discovery module, the weapons operator software can identify surveillance cameras on the surveillance video network. Using the location and range querying module, it can also determine which video surveillance images cover the general vicinity of a threat or target that a particular remotely operated weapon is addressing. Using the video switching and translation module, the weapon operator software can obtain and display video images from the relevant surveillance cameras. The relevant surveillance cameras might also change as an operator moves the aim of a weapon, and the software can automatically adjust the set of surveillance cameras to match the new aim vector of a weapon. Manual control of proximate surveillance cameras from weapons operator stations is performed via the control protocol translation module by enabling weapons operator stations to issue pan/tilt/zoom or other control commands to video surveillance cameras using similar controls and user interface gestures to those used to control remotely operated weapons. The automated selection, display, and control of video surveillance camera images to synchronize with movement of remote weapons allows the weapons operator software to also automatically select appropriate video surveillance images to display, and may automatically control video surveillance cameras to follow the aim of a remote weapon. For example, as the operator pans and tilts a remote weapon, commands can be automatically issued to nearby video surveillance cameras to pan and tilt to the same target location, so that operators can observe the target from multiple perspectives.

User interface and control software of surveillance control centers (e.g., CC1) are extended to incorporate weapon camera image management and weapon control 1620 and display of video images from remotely operated weapons into the control center. This enables a control center to control remotely operated weapons functions such as aiming, arming, and firing from the control center. These extensions are entirely parallel to those described in surveillance camera image management 1610 as described above, with the translation and mapping of images and commands occurring in the reverse direction (from the weapons network into the video surveillance network and user interfaces). The same modules of the invention described in surveillance camera image management 1610 are used to accomplish this translation and mapping. In some cases, new user interface gestures are added to the user interface for the surveillance control center to managed weapons-specific features that have no analog for surveillance cameras, such as arming and firing a weapon. However, some embodiments of the invention do not require these new gestures; instead the weapons are treated by the surveillance control center simply as additional surveillance cameras, with no ability to arm or fire the weapon Weapon simulator translator 1630 comprising software (and potentially hardware) is provided to allow the weapons network to view one or more video surveillance cameras as simulated weapons. These components comprising weapon simulator translator 1630 accept commands on the integrated weapons/surveillance camera network that are identical or similar to commands that would be sent to an actual remotely operated weapon. Weapon simulator translator 1630 translates these commands into commands for the camera or cameras functioning as a simulated weapon. The video routing and translation modules of the invention provide the capability for the video from the camera or cameras to be sent to the weapons operator station in a form that is consistent with video that would be sent from an actual weapon.

Figure 17:
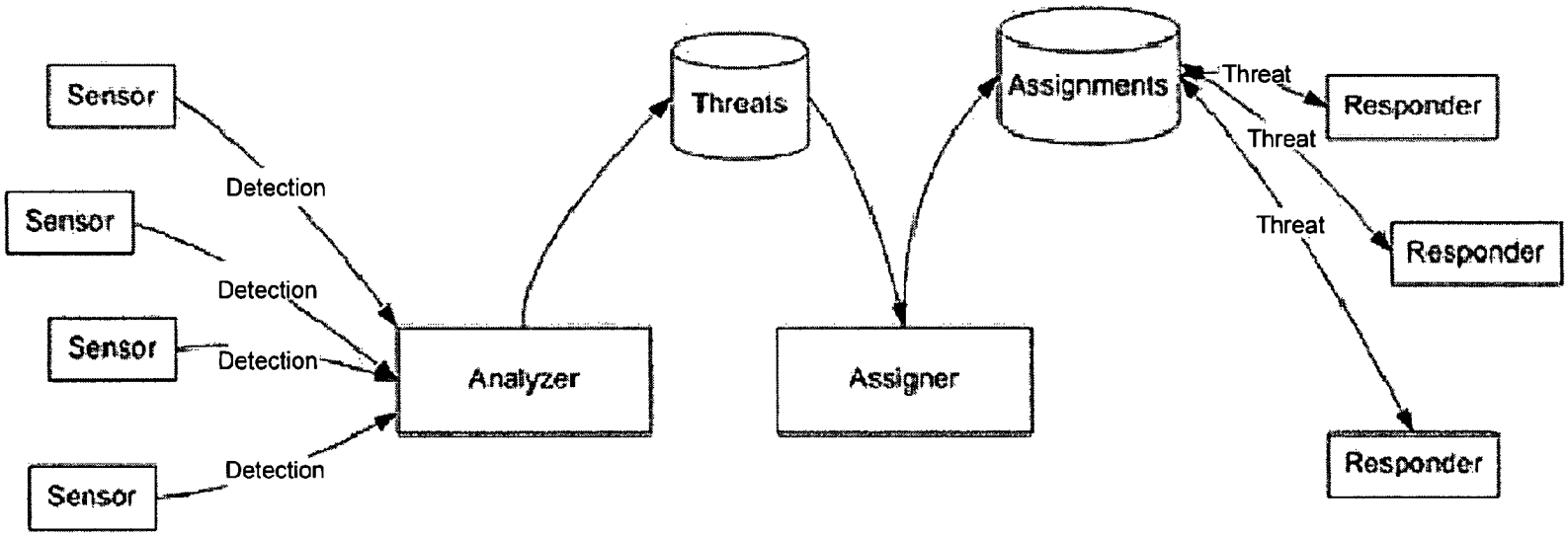
FIG. 17 shows an embodiment of the architecture that employs at least one analyzer, assigner and responder.

FIG. 17 shows an embodiment of the architecture that employs at least one analyzer, assigner and responder.

In one or more embodiments of the invention, the analyzer receives sensor detection messages and determines the existence, nature, location, and severity of threats. The analyzer may publish its assessment of threats to a threats database for example.

Many different algorithms may be utilized to map sensor detections into threat assessments. The system architecture allows swapping of analyzer algorithms without affecting other system modules. For example, an object oriented programming design pattern such as a strategy pattern may be employed to switch strategies (for example when low on ammunition, or when a particular alert level is in effect).

The analyzer may combine data from multiple sensors to make decisions with respect to threats. For example, redundant sensors may be used to confirm the existence of a threat or multiple sensors may be used to fix the location of threat.

The analyzer's decisions about threats may be fully automated, or they may include human review and judgment. An analyzer with human review may utilize a user interface to present detection information and to receive input from the user on threat decisions for example.

One or more embodiments of the invention may employ an assigner that assigns threats to responders. The assigner may for example publish assignments to an assignments database. Note that a single threat may be assigned to multiple responders, or multiple threats may be assigned to a single responder. Two major modes of assignment are supported:

"Push" assignments: The assigner explicitly chooses specific responders for specific threats. The assigner can use various algorithms to assign threats to responders.

"Pull" assignments: The assigner simply publishes all threats (with or without other responders) so that responders can observe them. Responders are then responsible for selecting specific threats to work on. When a responder selects a threat, this information may be added to the assignments database, so that other responders are aware that this threat has at least one other responder handling the threat. Again, a particular threat may be handled by more than one responder at a time.

As with the Analyzer, the Assigner may be fully automated or it may incorporate human review and judgment.

A responder is an active agent that can take control of a remote weapon and, if appropriate, use it to engage a threat.

A responder can take control of any remote weapon in the system.

The system architecture supports "auto-responders" as well as manual responders (human operators controlling remotely operated weapon systems). An auto-responder is a fully automated agent that receives a threat assignment and attempts to aim one or more weapons at the threat, and (if authorized) fire at the threat. Specific installations can be configured to support auto-responders or to only use manual responders. Auto-responders might also be disabled by default, with an option to turn them on in particular situations.

Auto-responder functionality includes auto-aiming (following a target) and auto-firing. A manual responder (a human operator) can choose to use the equivalent auto-aiming functionality, if desired, while retaining fully manual control of the firing decision.

The Threat Management System console uses a threat-centric paradigm rather than a weapon-centric one. This allows the operator(s) to focus on the threat, generally letting the computer choose the best weapon to engage that threat.

Figure 18:
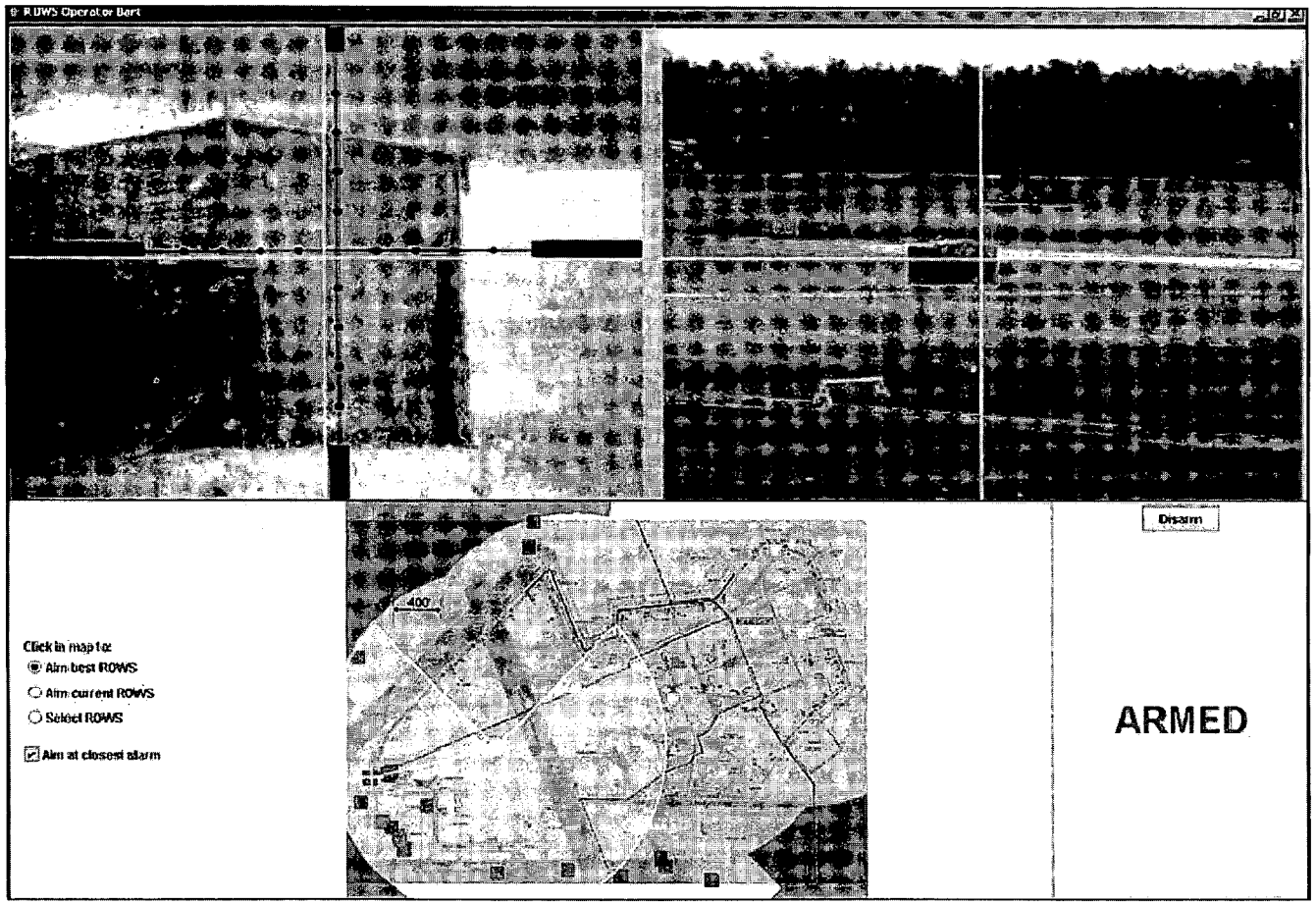
FIG. 18 shows an embodiment of the user interface showing multiple threats.

FIG. 18 shows an embodiment of the user interface showing multiple threats. The bottom half of the screen shows a map of the site being defended, overlaid with the threat picture as presented by the Threat Management System. Each red square represents a detected threat. The green circles show all of the weapons available at the site. The yellow circle represents the selected weapon. The coverage area for the selected weapon is depicted with shading on the map. The areas shown in grey have no weapon coverage.

The red armed light is on, showing that all arming switches in the system have been armed.

The box for "aim best weapon" is checked, allowing the operator(s) to focus on the threat and let the system determine which weapon is appropriate for engaging this threat.

The box for "aim at closest alarm" is checked, meaning that the operator merely needs to click near a threat in order for the software to choose a weapon, slew the weapon to the detected location of that threat, and let the operator control the weapon to track, assess, and if necessary, engage.

The display on the top half of the screen is a tactical window showing the view from the weapon camera sensor(s). The operator uses this display to track, assess, and engage targets with the weapon. The display is configurable to show all or any subset of the optics mounted on the weapon. This display is not active until a weapon has been selected. To avoid any confusion by the operator during an engagement, no images from other weapon systems can be displayed in this window. This ensures that the image corresponds to the aim of whichever weapon is selected (note that a supervisor station may view images seen by other operators, but may not engage or otherwise control the weapon while in supervisor mode).

Note that multiple operators may select the same threat; the second and third operators will get control of the second-best and third-best weapon, respectively.

Any of the components of the system may be simulated in whole or part in software in order to provide test points and integration components for external testing, software and system integration purposes. While the invention herein disclosed has been described by means of specific embodiments and applications thereof, numerous modifications and variations could be made thereto by those skilled in the art without departing from the scope of the invention set forth in the claims.

What is claimed is:

1. A network weapon system comprising:

a network;

at least one sensor configured to produce a corresponding at least one sensor data output wherein said at least one sensor is coupled with said network and wherein a first sensor selected from said at least one sensor produces a first sensor data output;

at least one operator user interface configured coupled with a computer system having a tangible memory medium, where said computer system is coupled with said network and said at least one user interface is configured to present said at least one sensor data output and wherein said at least one operator user interface comprises at least one weapon control interface;

at least one weapon coupled with said network wherein said at least one weapon control interface is configured to deliver a command to said at least one weapon to control said at least one weapon;

a communications protocol compatible with said network that allows said operator user interface to communicate with said at least one weapon and said at least one sensor;

said at least one operator user interface configured to display available weapons to a plurality of operators each having a respective operator user interface wherein said plurality of users utilize said respective operator user interface to coordinate use of said available weapons; and, wherein each of said at least one weapon comprises a state of said at least one weapon that is known to a plurality of operating stations.

2. The network weapon system of claim 1 wherein said state of said at least one weapon is accessible to said at least one operator user interface without storing said state in a single repository.

3. The network weapon system of claim 1 wherein said communications protocol comprises dynamic discovery of said at least one weapon or at least one sensor or at least one operator user interface or any combination of weapon, sensor or operator user interface.

4. The network weapon system of claim 1 wherein said at least one sensor is utilized as a simulated weapon.

5. The network weapon system of claim 1 wherein said at least one sensor is a component of a video surveillance system.

6. The network weapon system of claim 1 wherein said at least one weapon is authorized for operation by a supervisor.

* * * * *